US009915483B2

(12) United States Patent
Furumura et al.

(10) Patent No.: US 9,915,483 B2
(45) Date of Patent: Mar. 13, 2018

(54) FLUID HEAT EXCHANGING APPARATUS

(71) Applicant: PHILTECH Inc., Tokyo (JP)

(72) Inventors: Yuji Furumura, Kanagawa (JP); Naomi Mura, Tokyo (JP); Shinji Nishihara, Tokyo (JP); Noriyoshi Shimizu, Tokyo (JP)

(73) Assignee: PHILTECH, INC., Tokyo (JP)

( * ) Notice: Subject to any disclaimer, the term of this patent is extended or adjusted under 35 U.S.C. 154(b) by 424 days.

(21) Appl. No.: 14/567,103

(22) Filed: Dec. 11, 2014

(65) Prior Publication Data

US 2015/0159967 A1 Jun. 11, 2015

(30) Foreign Application Priority Data

Dec. 11, 2013 (JP) ..... 2013-255813

(51) Int. Cl.

| | |
|---|---|
| ***F28F 7/00*** | (2006.01) |
| ***F28F 3/08*** | (2006.01) |
| ***F28F 3/12*** | (2006.01) |
| ***F28F 13/06*** | (2006.01) |
| ***F22B 1/28*** | (2006.01) |
| *F28D 21/00* | (2006.01) |

(52) U.S. Cl.

CPC ..... *F28F 3/08* (2013.01); *F22B 1/288* (2013.01); *F28F 3/12* (2013.01); *F28F 13/06* (2013.01); *F28D 2021/0019* (2013.01)

(58) Field of Classification Search

CPC ..... F28F 3/08; F28F 3/12; F28F 13/06; F28F 3/086; F22B 1/288; F28D 2021/0019

USPC ..... 165/76

See application file for complete search history.

(56) References Cited

U.S. PATENT DOCUMENTS

| | | | | |
|---|---|---|---|---|
| 5,658,537 | A | 8/1997 | Dugan | |
| 7,000,684 | B2 * | 2/2006 | Kenny | F04B 17/00 165/104.21 |
| 2005/0082037 | A1 * | 4/2005 | Thayer | H01L 23/3733 165/80.4 |

(Continued)

FOREIGN PATENT DOCUMENTS

| | | |
|---|---|---|
| DE | 69506529 T2 | 6/1999 |
| JP | 32029579 A | 2/1987 |

(Continued)

OTHER PUBLICATIONS

Translation of JP2006343027.*

German First Office Action, English translation, dated Oct. 4, 2017.

*Primary Examiner* — Claire Rojohn, III

(74) *Attorney, Agent, or Firm* — BainwoodHuang

(57) ABSTRACT

A small-sized fluid heating/cooling apparatus for heating or cooling a large amount of gas or liquid at a low cost. Structures where a flow passage for a fluid is formed in a heated or cooled base formed in a plate shape or a column shape, and a fluid which has passed through the narrowed flow passage impinges on a wall of a side face of the base vertically to perform heat exchange are connected in series. Heat exchange is instantaneously performed in a small space and manufacture of a mechanism performing such an operation is easy. A material constituting the flow passage may be a metal or ceramics, and a small-sized fluid heat exchanging apparatus can be manufactured at a low cost.

12 Claims, 19 Drawing Sheets

(56) References Cited

U.S. PATENT DOCUMENTS

| | | | | |
|---|---|---|---|---|
| 2007/0034356 | A1* | 2/2007 | Kenny | F04B 17/00 165/80.4 |
| 2008/0169088 | A1* | 7/2008 | Aoki | H01L 23/473 165/104.19 |
| 2008/0173435 | A1* | 7/2008 | Schubert | H01L 23/473 165/165 |
| 2008/0196869 | A1* | 8/2008 | Behrens | F28F 3/12 165/104.33 |
| 2008/0196875 | A1* | 8/2008 | Kurtz | F28F 3/048 165/167 |
| 2013/0068434 | A1* | 3/2013 | Takano | F28F 3/025 165/170 |
| 2013/0302021 | A1* | 11/2013 | Furumura | F22B 1/28 392/491 |
| 2015/0136370 | A1* | 5/2015 | Furumura | F28F 3/12 165/165 |

FOREIGN PATENT DOCUMENTS

| | | | | |
|---|---|---|---|---|
| JP | 2004333083 | A | 11/2004 | |
| JP | 2006343027 | A * | 12/2006 | F28F 3/027 |
| JP | 2010001541 | | 1/2010 | |
| JP | 2011001591 | | 1/2011 | |
| KR | 1020130125277 | A | 11/2013 | |
| WO | 2006030526 | A1 | 3/2006 | |

* cited by examiner

FLUID HEAT EXCHANGING APPARATUS

BACKGROUND

The present invention relates to an apparatus for heating or cooling a fluid, particularly a gas, instantaneously.

As a heat exchanging apparatus, for example, there is an apparatus for heating a gas. A mechanism which is generally used at the highest frequency is a mechanism for causing a gas to pass through a pipe to heat the gas. Alternatively, a gas is heated by causing a heated fluid to flow through a pipe with fins and causing the gas to pass through between the fins. This mechanism is often used not only for heating a gas but also for heating a liquid or for producing a water steam.

On the contrary to heating a gas, a mechanism of an apparatus for cooling a gas is also a similar mechanism. This mechanism is currently the most popular mechanism.

Conventional invention examples for improving this general mechanism are shown in FIG. 1 and FIG. 2.

FIG. 1 is a view illustratively copied with a view of patent (Domestic Re-Publication of PCT Patent Application WO2006/030526) of one example of realizing a heating mechanism called "impinging jet". A gas which has passed through a pipe impinge on a heated hollow disk to perform heat exchange with the disc. A lamp heater for heating is not shown.

FIG. 2 (consisting of views 2A, 2B, 2C and 2D) is a view copied with a view of patent (Japanese Patent Application Laid-Open No. 2010-001541, FIG. 5 showing a film formation method and a film formation apparatus) of a plate-shaped apparatus for generating a heated gas instantaneously.

An apparatus for heating a gas instantaneously to jet a high-temperature gas is applied to not only warming and drying but also various steps of heating various materials (a metal, a dielectric, and the like) which have been applied to a substrate to fire the same. The above inventions are effective for heating a liquid such as a water.

Though heating is described as examples below, since a similar technique can be applied to cooling, a title of the present invention is comprehensively defined as a fluid heat exchanging apparatus. The present invention relates to an apparatus for heating or cooling a gas instantaneously.

It is desired that while an exchanging efficiency of heat is made good, an apparatus for heating or cooling a gas is made as small as possible. It is desired that a manufacturing method is made simple and an inexpensive manufacturing is achieved by selecting a structural material.

For example, it is also desired that a temperature range at a heating time is set to a temperature range from the room temperature to 1000° C. or higher. If working is made easy, a manufacturing cost can also be made inexpensive. If the manufacturing cost becomes inexpensive, application industries of a gas heating apparatus are expanded.

SUMMARY OF THE INVENTION

A basis mechanism of the present invention for solving the issues is shown in FIG. 3. FIG. 3 shows a basic principle for performing heat exchanging efficiently.

FIG. 3 is a schematic view of a mechanism for performing heat exchange utilizing a plate and sealing plates. An action where the plate produces a high-speed gas to impinge the produced high-speed gas on the sealing plates is continuously caused.

Tubs G11 and G21 are formed on an upper face of a plate 300 and tubs G12 and G22 are formed on a lower face thereof. Each of these tubs has a bottom face, and has a depth Dtub defined by a distance between the upper face or the lower face of the plate 300 and the bottom face of the tub. These tubs are sealed by sealing plates 303 and 305 above and below the plate 300 to form parts of a flow passage. The tub G12 is coupled to the tubs G11 and G21 through coupling holes H12 and H21 in a plane arrangement bridging the tubs G11 and G21. That is, the tub G12 has an overlapping portion OP with each of the tubs G11 and G21 in a plane view, and the tub G12 is coupled with each of the tubs G11 and G21 through the coupling holes H12 and H21 respectively in the overlapping portion OP.

The tub G21 is coupled to the tubs G12 and G22 through coupling holes H21 and H22 in a plane arrangement bridging the tubs G12 and G22. That is, the tub G21 has an overlapping portion OP with each of the tubs G12 and G22 in a plane view, and the tub G21 is coupled with each of the tubs G12 and G22 through the coupling holes H21 and H22 respectively in the overlapping portion OP. A fluid introduction port 301 is coupled to the tub G11 at a right end of the tub arrangement. A fluid outlet port 307 is coupled to the tub G22 at a left end in the tub arrangement.

An introduction fluid 302 introduced from the fluid introduction port 301 is discharged as a discharge fluid 308 from the fluid outlet port 307 through the tub G11, the coupling hole H12, the tub G12, the coupling hole H21, the tub G21, the coupling hole H22, and the tub G22 which are sealed. The sealing plates 303 and 305 are provided with heaters 304 and 306, respectively, so that the sealing plates 303 and 305 are in a heated state. Any number of heaters can be arbitrarily provided according to quantity of heat to be exchanged between the fluid and the sealing plates 303 and 305.

A fluid which has passed through the thin coupling hole H12 is increased in speed to impinge on the sealing plate 305 at a high speed vertically. Each of the coupling holes H12, H21 and H22 has a length Lhole defined by a distance between the bottom face of the tub formed on the upper face of the plate 300 and the bottom face of the tub formed on the lower face of the plate 300. A distance between a sealing plate surrounding a tub and an outlet of a coupling hole is shorter than the length Lhole of the coupling hole in order to cause the vertical high-speed impingement. That is, the length Lhole of the coupling hole is longer than the depth Dtub of the tub. When such a structure is manufactured, since a stagnating layer produced between a vertical high-speed fluid and a wall of the sealing plate becomes thin, the heat of the sealing plate is transferred to the fluid in a heat exchanging manner instantaneously.

The same event also occurs even regarding the coupling holes H21 and H22. When the vertical high-speed impingement is repeated in this manner, heat of the sealing plate which has been heated by the heater is transferred to the fluid at high efficiency. As a result, the temperature of the discharged fluid reaches a temperature close to the temperature of the sealing plates. Angles at which the fluid impinges on the sealing plates 303 and 305 are not required to be strictly vertical because only thinning of the stagnating layer is required.

Thus, the fluid heat exchanging apparatus shown in FIG. 3 performs heat exchange instantaneously to produce a heated fluid.

If the sealing plates are cooled, this apparatus serves as an apparatus for producing a cooling fluid instantaneously. As a material (mechanism material) constituting a mechanism of the apparatus, a metal or ceramics can be utilized according to the property or a desired temperature of the fluid.

It is possible to select a composite material as the mechanism material of the apparatus. As the composite material, there is a plastic mixed with metal fibers or carbon fibers. Further, as the carbon, there is a carbon nanotube or graphene having excellent heat conduction.

The mechanism can be manufactured by cutting a mechanism material. According to the property of the material for the apparatus, it is possible to heat or cool various fluids such as a gas or a liquid. The number of fluid outlet ports, the shape of the fluid outlet port, the number of fluid inlet ports, and the shape of the fluid inlet port can be designed arbitrarily, respectively.

Therefore, a beam of a heated or cooled gas can be produced in various forms.

The function and the material of the basic structure of the apparatus has been described above. In the above structure, the flow passage is formed so as to penetrate the plate to cross the same. It is also possible to form the flow passage on a surface of the plate instead of forming the flow passage in the plate.

A structure where the tubs formed on the upper face and the lower face of the plate shown in FIG. 3 are alternately arranged on one face of the plate and tubs adjacent to each other are coupled to each other by a coupling hole is a one face structure where the coupling hole does not extend through the plate.

The structure having the one face flow passage has such a feature that since the flow passage is formed on one face, the number of parts can be reduced.

Further, it is possible to make one face of a plate cylindrical to form a flow passage on the face. The basic structure is shown in FIG. 8.

The tub shown in FIG. 3 has a simple rectangular shape. As viewed in section, the depth of the tub is shallower than the length of the opening of the tub, and is shallower than the length of the coupling hole.

On the contrary, tubs G81, G82, G83, and G84 shown in FIG. 8 are relatively deep. That is, as viewed in section, the depths of the tubs are deeper than the lengths of openings thereof and coupling holes H812, H823, and H824 are also relatively long.

Cutting work of the tub whose bottom cannot be seen from the above since it is hidden behind is required such that the fluid which has gone out of the coupling hole causes vertical high-speed impingement on a wall surrounding the tub.

For simplifying the working of the tub, there is a structure where the orientation of the coupling hole is make oblique.

In examples, a structure where cutting work of a tub was made easy by adopting an oblique coupling hole structure was used. A plate is sealed by a sealing plate 804 in order to form a closed flow passage.

Through the plate-shaped plate has been explained, a flow passage structure can be manufactured not only on a face of the plate but also on a surface of a cylinder, a square pillar or a polygonal pillar. At this time, the sealing plates may be separated from the plate. By coupling the sealing plates, they form a cylindrical shape.

A fluid to be heated or cooled by the above heat exchanging apparatus may be a gas or a liquid. The above-described fluid may be, for example, nitrogen, argon, helium, hydrocarbon, or fluorocarbon, and it may be a gas or a liquid. Alternatively, hydrogen or a reducing gas discharging hydrogen, or an oxidizing gas containing an element of group VIB such as oxygen or sulfur, selenium or tellurium can be utilized as the fluid.

A gas containing halogen element of group VIIB such as fluorine can also be utilized.

The gas may be water, steam, or a gas containing steam having a temperature of 100° C. or higher or air. Since water can be utilized as a material for producing a steam gas without preparing a gas specially, it can be used as a gas which does not contain an oxygen gas.

High-temperature steam having a temperature in a range from 500° C. to 1000° C. or a higher temperature especially has a high ability to decompose an organic matter. When organic waste such as meat, vegetable, wood chips, or plastics is brought into contact with the high-temperature steam, molecules are cut or decomposed to generate a gas containing hydrogen, carbon, or oxygen. Even when steam having a temperature lower than the above temperature is utilized, sinews of meat are changed by bringing the steam into contact with the meat so that the meat can be changed to soft meat prone to bite.

The above gas with a high chemical potential taken out by bringing the high-temperature steam and the waste into contact with each other can be reused as an energy resource. Therefore, an apparatus for performing this matter is a treatment apparatus for an organic waste.

When air is compressed to be used, a heating gas can be obtained inexpensively. When the heat exchanging apparatus is cooled to be used, it can be used for liquefying water content in air.

The gas may be a gas containing an element discharging radioactivity. It is necessary to cool rapidly a high-temperature gas containing a large amount of radioactivity which is generated when a material is cooled by a gas in a nuclear power plant. At such a time, the apparatuses can be used by connecting the apparatuses in series or in parallel to a flow passage through which the high-temperature gas flows.

The fluid may be water or an aqueous solution. The above heat exchanging apparatuses can be used by changing set temperatures for heating or cooling of the heat exchanging apparatuses and connecting the heat exchanging apparatuses in series in the flow passage where the fluid flows. For example, when sea water is heated by the heat exchanging apparatuses and heated sea water is sprayed at a high temperature air obtained by the heat exchanging apparatuses, salt can be separated from the sea water as a solid material.

Particularly, when the heat exchanging apparatus is heated and used, while considering a reaction with a fluid, a constituting material is properly selected from a metal, ceramics, or a composite material containing carbon or metal to be used.

When the metal is used as the constituting material, a metal coated with a different kind of metal may be used according to a fluid to be used.

Besides the metal, metal oxide, silicon oxide, aluminum oxide, titanium oxide, nickel oxide, and ceramics containing silicon carbide can be properly selectively used as the constituting material.

A material obtained by coating carbon with silicon carbide can also be selected. When a composite material containing carbon is used as the constituting material, carbon nanotube or graphene with excellent heat exchange can be selected. Since plastics containing carbon can be worked in a die and cutting work thereof is easy, a structure can be manufactured inexpensively.

When the structure of the present invention is manufactured using the above-described carbon composite material, a heat exchanging apparatus using high-temperature steam containing acid or alkaline as a heat source can be manufactured and used. The numbers of tubs and holes, the sizes of the tub and the hole of the above-described heat exchanging apparatus can be designed arbitrarily.

First Embodiment

One or more embodiments of the present invention are fluid heat exchanging apparatuses provided with a plate having tubs, coupling holes, an introduction port, and a blowout port, and two sealing plates provided on both front and back faces of the plate, wherein the tubs are provided on both a front surface and a back surface of the plate so as to be arranged in one direction in a plurality of stages; tubs of the tubs provided on one face of the plate and tubs of the tubs provided on the other face of the plate are sealed by the two sealing plates in an air-tight manner; one of the tubs provided on the one face of the plate has an overlapping portion with adjacent two tubs provided on the other face of the plate; the coupling holes are formed to be longer than depths of the tubs, and couple the tubs provided on the one face of the plate and the tubs provided on the other face of the plate in the overlapping portion; the introduction port introduces a fluid into a tub of the tubs provided on one end of the plate; the blowout port discharges the fluid from a tub of the tubs provided on the other end of the plate; and heat exchange is performed between the sealing plates and the fluid.

Second Embodiment

One or more embodiments of the present invention are the fluid heat exchanging apparatus described in the above first embodiment, where the fluid is a gas or a liquid.

Third Embodiment

One or more embodiments of the present invention are the fluid heat exchanging apparatus described in the above second embodiment, where the gas is a gas obtained by combining at least one of an inert gas containing nitrogen, argon, helium, hydrocarbon, or fluorocarbon; hydrogen or a reducing gas discharging hydrogen; a gas containing an element of group VIB containing oxygen, sulfur, selenium, and tellurium; and a gas containing an element of group VIIB such as fluorine.

Fourth Embodiment

One or more embodiments of the present invention are the fluid heat exchanging apparatus described in the above second embodiment or the third embodiment, where the gas is a gas containing water or air.

Fifth Embodiment

One or more embodiments of the present invention are the fluid heat exchanging apparatus described in the above second embodiment, where the liquid is water.

Sixth Embodiment

One or more embodiments of the present invention are the fluid heat exchanging apparatus described in any one of the above first embodiment to the fifth embodiment, where the sealing plates and the plate are made of metal or metal coated with a different kind of metal.

Seventh Embodiment

One or more embodiments of the present invention are the fluid heat exchanging apparatus described in any one of the above first embodiment to the fifth embodiment, where the sealing plates and the plate are made of either one of ceramics containing graphite, alumina, silicon carbide or the like and a composite material containing carbon such as carbon nanotube or graphene.

Eighth Embodiment

One or more embodiments of the present invention are the fluid heat exchanging apparatus described in any one of the above first embodiment to the seventh embodiment, where the sealing plates are heated by inserting heaters into the sealing plates or bringing heaters into close contact with the sealing plates, or the plate is heated.

Ninth Embodiment

One or more embodiments of the present invention are the fluid heat exchanging apparatus described in any one of the above first embodiment to the eighth embodiment, where the sealing plates or the plate is cooled.

Tenth Embodiment

One or more embodiments of the present invention are the fluid heat exchanging apparatus described in any one of the above first embodiment to the ninth embodiment, where the fluid heat exchanging apparatus is expanded at a right angle direction to flow of the fluid, or the fluid heat exchanging apparatuses are connected in parallel and a plurality of the induction ports and a plurality of the blowout ports are provided, or the shape of the blowout port is made long in a slit shape.

Eleventh Embodiment

One or more embodiments of the present invention are the fluid heat exchanging apparatus described in any one of the above first embodiment to the tenth embodiment, where the two plates are sandwiched by utilizing the three sealing plates, and heat of the sealing plate positioned at a center is conducted to the fluid via the two plates sandwiching the sealing plate positioned at a center.

Twelfth Embodiment

One or more embodiments of the present invention are fluid heat exchanging apparatuses having a structure for performing heating or cooling and provided with tubs, coupling holes, and a base provided with a flow passage, wherein a plurality of the tubs are arranged so as to be spaced from one another; each of the coupling holes connects the tubs adjacent to each other, a fluid passing through the coupling hole is caused to impinge on walls of the tubs to perform heat exchange between the walls and the fluid; the flow passage discharges a fluid which has been introduced from a tub of the tubs provided at one end of the arrangement from a tub of the tubs provided at the other end of the arrangement; and axes of nearest coupling holes in a relationship between an upstream side and a downstream side of the above-described fluid to each other do not overlap with each other.

Thirteenth Embodiment

One or more embodiments of the present invention are the fluid heat exchanging apparatus described in the above twelfth embodiment, where the flow passage is formed on a surface of the base formed in a shape of a column or a prism.

Fourteenth Embodiment

One or more embodiments of the present invention are the fluid heat exchanging apparatus described in the above twelfth embodiment or thirteenth embodiment, where a material for the base is either one of a metal or a multi-element metal; a laminated metal coated with a different kind of metal; ceramics containing metal oxide, silicon oxide, aluminum oxide, titanium oxide, nickel oxide, or silicon carbide; carbon coated with silicon carbide; and a composite material containing carbon such as carbon nanotube or graphene.

Fifteenth Embodiment

One or more embodiments of the present invention are the fluid heat exchanging apparatus described in any one of the above twelfth embodiment to fourteenth embodiment, where the fluid is either one of an inert gas containing nitrogen, argon, helium, and hydrocarbon, and fluorocarbon; hydrogen or a reducing gas discharging hydrogen; an oxidizing gas containing an element of group VIB such as oxide, sulfur, selenium, or tellurium; and a gas containing halogen element of group VIIB such as fluorine.

Sixteenth Embodiment

One or more embodiments of the present invention are the fluid heat exchanging apparatus described in any one of the above twelfth embodiment to fifth embodiment, where the fluid is a gas containing water or air.

Seventeenth Embodiment

One or more embodiments of the present invention are the fluid heat exchanging apparatus described in any one of the above twelfth embodiment to fifteenth embodiment, where the fluid is water or an aqueous solution.

Eighteenth Embodiment

One or more embodiments of the present invention are fluid heat exchanging apparatus where a plurality of the fluid heat exchanging apparatuses described in any one of the above twelfth embodiment to seventeenth embodiment are connected in series and the temperature of the base is set for each of the fluid heat exchanging apparatuses.

Nineteenth Embodiment

One or more embodiments of the present invention are apparatuses for bringing a high-temperature steam produced by the fluid heat exchanging apparatus described in any one of the first embodiment to the eighth embodiment and an organic matter into contact with each other.

According to one or more embodiments of the present invention, a fluid flowing in a flow passage formed by a simple plate mechanism and sealing plates impinges on the sealing plates at a high speed to be capable of performing heat exchange with the sealing plates efficiently. Necessary working on the plate mechanism includes only tub cutting work performed to the plate and drilling work for forming a hole for coupling tubs to each other (hereinafter, called "coupling hole").

It is possible to weld the sealing plates and the pale to achieve complete sealing and fixing them by using screws. When a fluid flows in a thin coupling hole bored by using a drill with a proper diameter, the flow speed of the fluid is increased.

The high-speed fluid impinges a wall of the sealing plate or the tub vigorously to perform heat exchange with the heated wall instantaneously. A mechanism causing this impingement continuously is a heat exchanging mechanism of the plate.

Since a plurality of coupling holes are provided, they do not act as heat resistance to the fluid. Since the tub is a shallow tub with a depth of about 1 mm to 2 mm, a fluid which is relatively fast to the sealing plate occurs, a stagnating layer formed between the fluid and the sealing plate becomes thin, so that efficiency of heat exchange is increased by the thinness.

Working for forming a flow passage in the plate is completed by only working for producing tubs with a depth of 1 to 2 mm by using an end mill and working for boring coupling holes connecting tubs by using a drill. The inlet port and the outlet port for a fluid are formed by only drilling work.

The manufacture of this mechanism reduces the number of manufacturing steps and is simple. According to one or more embodiments of the present invention, a gas and a liquid can be handled as the fluid. When oxygen is selected as the fluid, heated oxygen can be produced instantaneously.

When hydrogen is selected as the fluid, a powerful high-temperature reducing gas can be produced instantaneously. By blowing these high-temperature gases on to a base material, a surface of the base material can be treated by the heated gas without heating the base material itself.

When water is selected as the fluid, high-temperature steam can be produced instantaneously. Since the fluid heat exchanging apparatus can be manufactured as a small-sized apparatus, it is possible to bring the fluid heat exchanging apparatus in close to a base material to be blown to blow steam thereto.

Since a heated high-temperature steam is effective for cleaning the base material without using chemicals, the fluid heat exchanging apparatus can be applied as a part for a cleaning apparatus.

According to one or more embodiments of the present invention, the fluid heat exchanging apparatus can be manufactured from a metal or ceramics. When the sealing plate and the plate are manufactured from a metal and connection portions are welded, a sealing mechanism can be obtained, and a fluid heat exchanging apparatus shielded from an external environment can be manufactured.

When a material such ceramics which are not oxidized is used, even an oxidizing gas or a corrosive fluid is heated instantaneously. Further, use to application disliking metal contamination is possible.

According to one or more embodiments of the present invention, it is possible to heat the sealing plate by only boring a hole toward a flowing direction of a fluid in the sealing plate and putting a heater in the hole. Since this mechanism is simple and the number of heaters are set arbitrarily, heat exchangeable power can be set simply. By surrounding the heater and the sealing plate with a heat insulating material, heat discharged outside of the heat insulating material can be controlled to a low level, so that a utilizing efficiency of heat can be made high.

It is also possible to cool an introduction fluid by cooling the sealing plate. For the cooling, coolant used in an ordinary refrigerator may be used or a cooling plate using Peltier effect may be used since it is available.

According to one or more embodiments of the present invention, it is possible to expand the apparatus in a direction at a right angle to a flow of the fluid to produce a beam of the fluid having a long width. A heated gas beam having a long width can be utilized to heat surfaces of a large-sized metal thin sheet, a large-sized glass, and a large-sized resin sheet which have 1 m class or larger.

According to one or more embodiments of the present invention, it is possible to manufacture a cylindrical fluid heat exchanging apparatus, and even a large-sized plate-shaped fluid heat exchanging apparatus can be worked easily. In the case of the cylindrical fluid heat exchanging apparatus, working for forming a flow passage can be performed by only cutting work of tubs performed by using a lathe and work for boring coupling holes connecting tubs by a drill. By inclining an axes of the coupling holes, axes of nearest coupling holes in a relationship between an upstream side and downstream side to each other do not overlap with each other. The non-overlapping axes created by the inclination prevent occurrence of a laminar flow and produce vertically-impinging turbulence continuously. Thereby, the heat exchange efficiency is raised.

According to one or more embodiments of the present invention, a material for forming the flow passage can be selected according to chemical properties of a fluid to be handled. When the fluid to be handled has a high temperature, ceramics are effective as the material. However, when a degree of sealing obtained by welding is required, a metal is suitable as the material. A metal strong even in a high-temperature state is effective for use at a high temperature. When plastics containing carbon nanotube or graphene is used, a chemically-corrosive fluid can be handled and the chemically-corrosive fluid can be used as a heat source. If this is made possible, the fluid heat exchanging apparatus can be used as a heat exchanger in a geothermal power generation.

According to one or more embodiments of the present invention, the kind of gas can be selected according to intended use. An inert gas is effective for heating a surface of an object instantaneously, and a reducing gas is effective for baking a material applied to a surface of a base plate in a reducing atmosphere. Annealing with a gas containing selenium or the like, it is effective for sintering of crystals of CIGS (Cu, In, Ga, Se).

According to one or more embodiments of the present invention, it is possible to perform transportation while components and temperature of a high-temperature waste gas in a chimney, an institution, or facilities are being maintained. This is effective for contamination monitoring.

According to one or more embodiments of the present invention, the present invention is effective to produce a high-temperature steam instantaneously and it is also convenient for instantaneous heating at use points of chemicals.

According to one or more embodiments of the present invention, such continuous processes can be performed in a small space as a process of heating a component-mixed liquid to perform condensation of the liquid through rapid evaporation in a first fluid heat exchanging apparatus and a process of cooling the condensed component-mixed liquid to condensate a solid component and perform separation of the solid component in a second fluid heat exchanging apparatus.

According to one or more embodiments of the present invention, it is possible to take a reusable gas high in chemical potential from meat, vegetable, or wood chips to reuse the same as a fuel resource.

DETAILED DESCRIPTION

Figure 4:
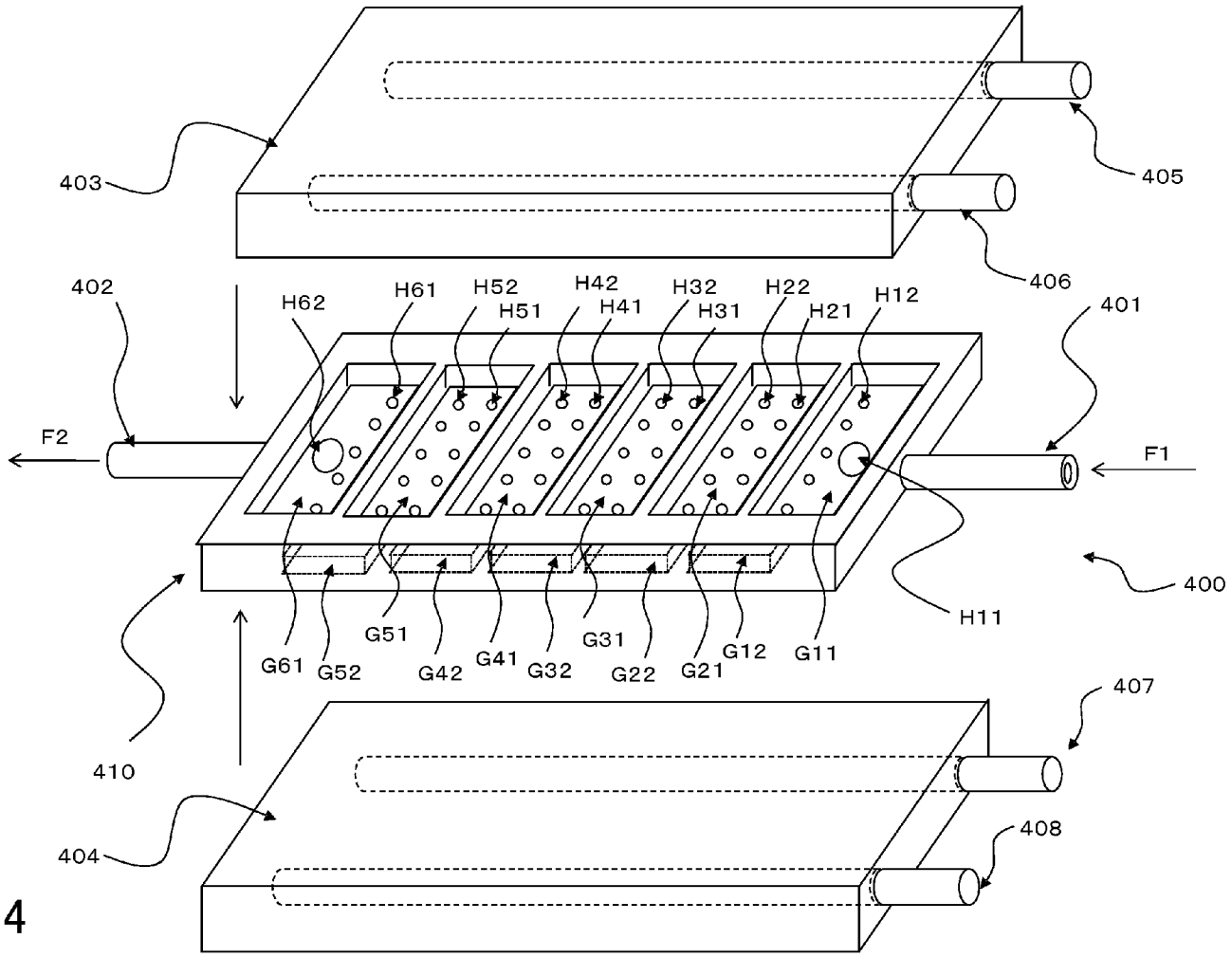
FIG. 4 is a perspective view of a fluid heat exchanging mechanism where a flow passage is formed by sandwiching a plate part by sealing plates.

FIG. 4 shows a perspective view of a fluid heat exchanging mechanism 400 where a flow passage is formed by sandwiching a plate part by sealing plates. Sealing plates 403 and 404 are provided with heaters 405, 406, 407 and 408.

The plate 410 and the sealing plates 403 and 404 are made of stainless steel, and one meeting the standard SUS316L is used as the stainless steel. Tubs G11, G12, G21, G22, G31, G32, G41, G42, G51, G52, and G61 are manufactured so as to be spaced from one another by 2 mm by working both faces of the plate. A depth of the tub is 1 mm and an area of the tub is set to 4 mm×30 mm. Coupling holes H12, H21, H22, H31, H32, H41, H42, H51, H52, and H61 couple tubs to each other. The number of coupling holes bored by a drill is in a range from 5 to 10. The coupling hole has a diameter of 2 mm and a length of 3 mm.

A distance from an outlet of the coupling hole to a wall surrounding the tub on which a fluid impinges is shorter than the length of the coupling hole such that the fluid goes out of an outlet of the coupling hole at a high speed to impinge on the wall surrounding the tub. A relationship between the distance from the outlet of the coupling hole to the wall on which a fluid impinges and the length of the coupling hole lies in a relationship effective for causing heat exchange efficiently.

The coupling holes H11 and H62 coupling a fluid introduction port 401 and a fluid outlet port 402, and the tubs were bored by a drill. After the fluid introduction hole 401 was welded, cleaning was performed, and the sealing plates 403 and 404 and the plate 410 were welded. Thus, the flow passage for a fluid was formed.

The heaters 405, 406, 407, and 408 are inserted into the sealing plates 403 and 404. For easy understanding, the heaters are illustrated so as to project from the sealing plates. The heaters may be actually provided in the sealing plates.

The heater may be provided in the center of the sealing plate. Though an example where four heaters are provided is shown, only one heater may be provided, which can be designed arbitrarily.

Figure 5:
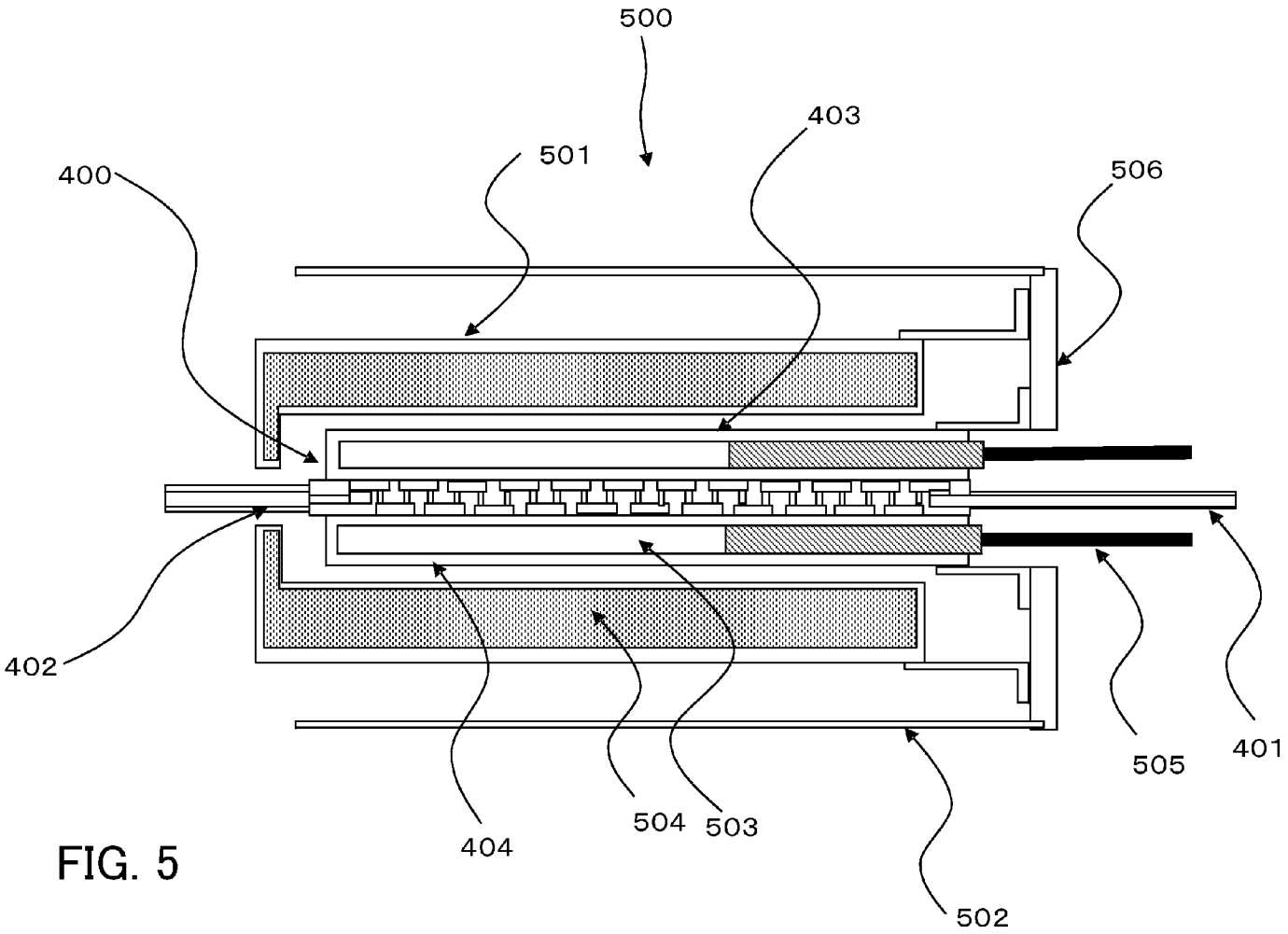
FIG. 5 is a schematic sectional view of a fluid heat exchanging apparatus showing an entire case housing a fluid heat exchanging mechanism section.

FIG. 5 is a schematic sectional view of a fluid heat exchanging apparatus 500 showing an entire case housing a fluid heat exchanging mechanism 400.

The fluid heat exchanging mechanism 400 is heated by heaters 503 power-fed from heater power-feeding wires 505. The heater 503 is made of silicon carbide and it can perform heating up to a temperature of 1000° C.

The fluid heat exchanging apparatus 500 is configured by housing the fluid heat exchanging mechanism 400 in a heat-isolating case 501 and an outer case 502.

The fluid heat exchanging mechanism 400 is heat-isolated by the heat-isolating case 501 receiving a heat-isolating material 504 therein. The outer case 502 made of stainless steel is arranged outside of the heat-isolating case 501 and an end thereof is connected to a flange 506. A fluid outlet temperature of the fluid heat exchanging mechanism 400 is measured by a thermocouple (not shown), and power is controlled such that a required temperature is maintained. A set temperature of the fluid outlet was set at 500° C. in order to produce nitrogen heated up to 500° C.

A nitrogen gas is supplied from the fluid introduction port 401 at a rate of 100 SLM. The nitrogen gas is heated in the fluid heat exchanging mechanism 400 instantaneously. The nitrogen heated up to 500° C. goes out of the fluid outlet port 402. When the heating temperature is set at 300° C., nitrogen having an approximately same temperature of 300° C. is obtained.

The example for heating a nitrogen gas has been described above. It is possible to use a gas other than the nitrogen gas in the heating mechanism.

For example, an inert gas containing argon, helium, hydrocarbon, or fluorocarbon, hydrogen or a reducing gas discharging hydrogen, a gas containing an element of group VIB such as oxygen, sulfur, selenium or tellurium, or a gas containing an element of group VIIB such as fluorine can be also used. Further, a gas composed of a plurality of gases of these gases may be used.

Further, the gas may be a gas containing water or air.

A fluid other than the gas can be used arbitrarily. For example, when the fluid is water, it is possible to produce a high-temperature steam.

Parts were manufactured by using SUS316L in the above example. Proper material is selected arbitrarily according to a temperature range to be used or properties of a fluid. A material constituting parts is not only a metal such as stainless steel or aluminum but also a metal coated with a different kind of metal.

Further, when metal contamination is especially disliked, the parts may be made of ceramics containing graphite, alumina, or silicon carbide.

Figure 6:
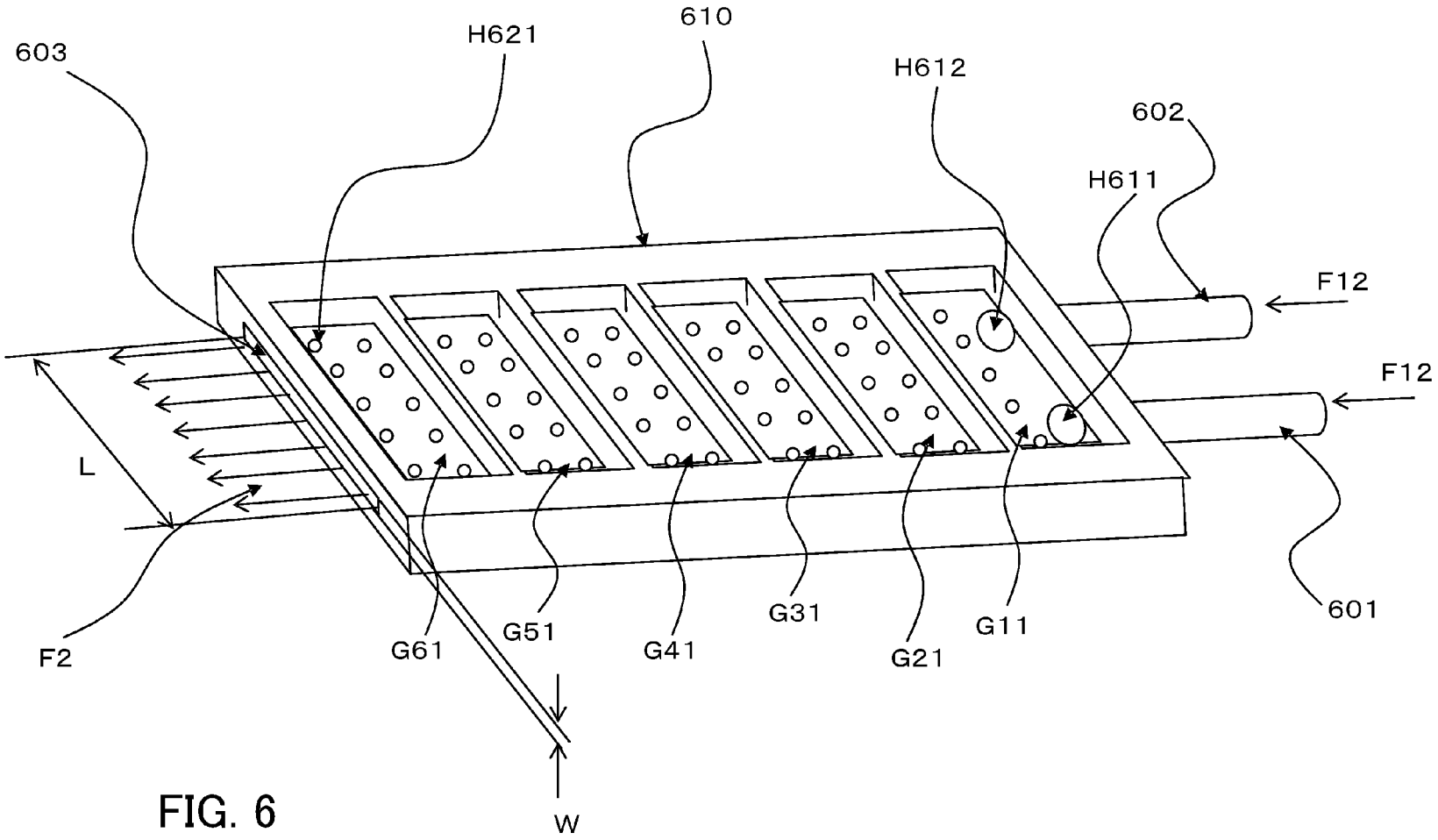
FIG. 6 is a perspective view of a fluid heat exchanging apparatus showing modified aspects of a fluid introduction port and a fluid outlet port.

FIG. 6 shows a plate 610 which is a modified example of the plate 410. The plate 610 is provided with fluid introduction ports 601 and 602. Introduction fluids F11 and F12 introduced from the respective fluid introduction ports 601 and 602 are introduced while flow rates thereof are being controlled by a flow rate control apparatus (not shown). The fluids F11 and F12 may be the same fluid or may be different fluids. There are coupling holes H611 and H612 in the tub G11 of the tubs G11, G21, G31, G41, G51, and G61. The coupling holes H611 and H612 may be provided in different tubs.

Coupling holes H621 coupled to the tub G61 are coupled to a fluid outlet port 603 which is an outlet for a discharge fluid heat-exchanged and discharged. The fluid outlet port 603 is formed in a slit shape having a length L and a width W.

If a gap having a length L and a clearance W is established between the sealing plate 403 and the plate to be utilized as a fluid outlet port 603 (not shown), the gap serves as the fluid outlet port 603 without performing working for forming the coupling holes H621.

The length L of the fluid outlet port is increased according to expansion of the length of the plate 610. The length L of the discharge fluid can be expanded by connecting plates 610 in parallel to connect respective fluid outlet ports of the plate 610 to form one fluid outlet port.

Figure 7:
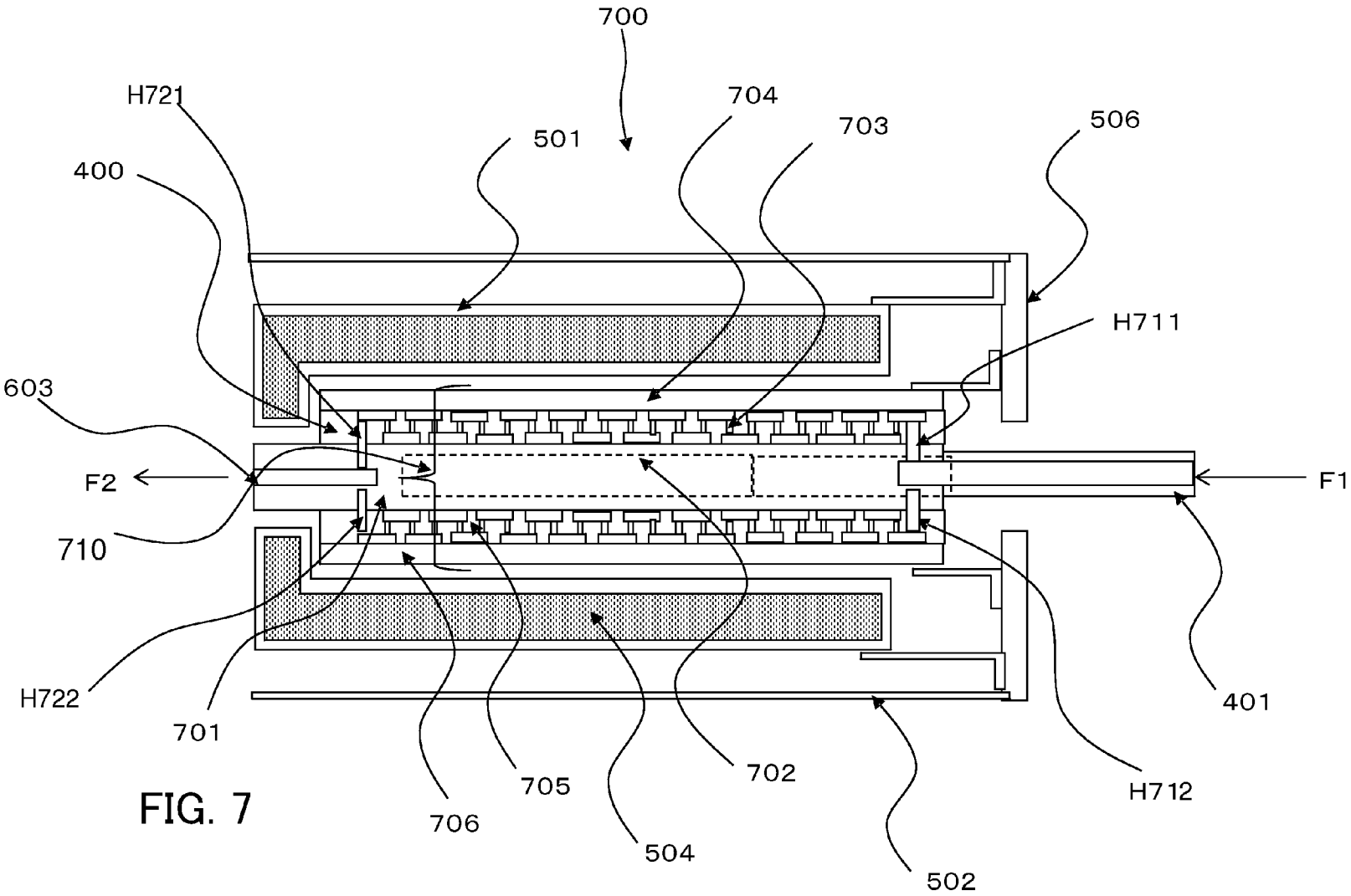
FIG. 7 is a schematic sectional view of a fluid heat exchanging apparatus provided with two heat exchanging plates.

FIG. 7 shows a fluid heat exchanging apparatus 700 as a modified example of the fluid heat exchanging apparatus. The fluid heat exchanging apparatus 700 has a heater center sealing plate 701 at the center of the apparatus, and the sealing plate is provided with a heater 702. Two plates 703 and 705 forming gas heating flow passages are provided on both sides of the sealing plate 701. Sealing plates 704 and 706 are provided outside of the plates, and gas flow passages sealed by these sealing plates and the plates are provided in a two-line fashion.

An introduction flow F1 is divided into two flows through coupling holes H711 and H712 to be guided to the two plates 703 and 705. The heated fluids are collected to the heating center sealing plate 701 through coupling holes H721 and H722, so that a discharge fluid F2 is discharged from the fluid outlet port 603.

A heat isolating case 501 is provided so as to enclose a fluid heat exchanging mechanism 710 formed by these sealing plates and plates, and an outer case 602 is provided so as to enclose the heat isolating case 501. The heat isolating case 501 and the outer case 602 are fixed to a flange 506.

The fluid heat exchanging apparatus 700 having such a structure that the heating center sealing plate 701 heated by the heater is provided at the center of the apparatus 700, the heating center sealing plate 701 is provided with the fluid introduction port 401, and the heating center sealing plate 701 is sandwiched between the plates 703 and 705 having a heat exchanging structure is manufactured as described above. The fluid heat exchanging apparatus 700 provides a structure capable of obtaining a large flow rate and lowering a temperature in an outward direction.

The above was the example of the structure where tubs for heat exchange were formed on both front and back faces of the plate and the flow passage crossed the plate. An example having a structure where tubs are formed on one face of a plate serving as a base and a flow passage does not cross the plate serving as a base will be shown next.

Figure 8:
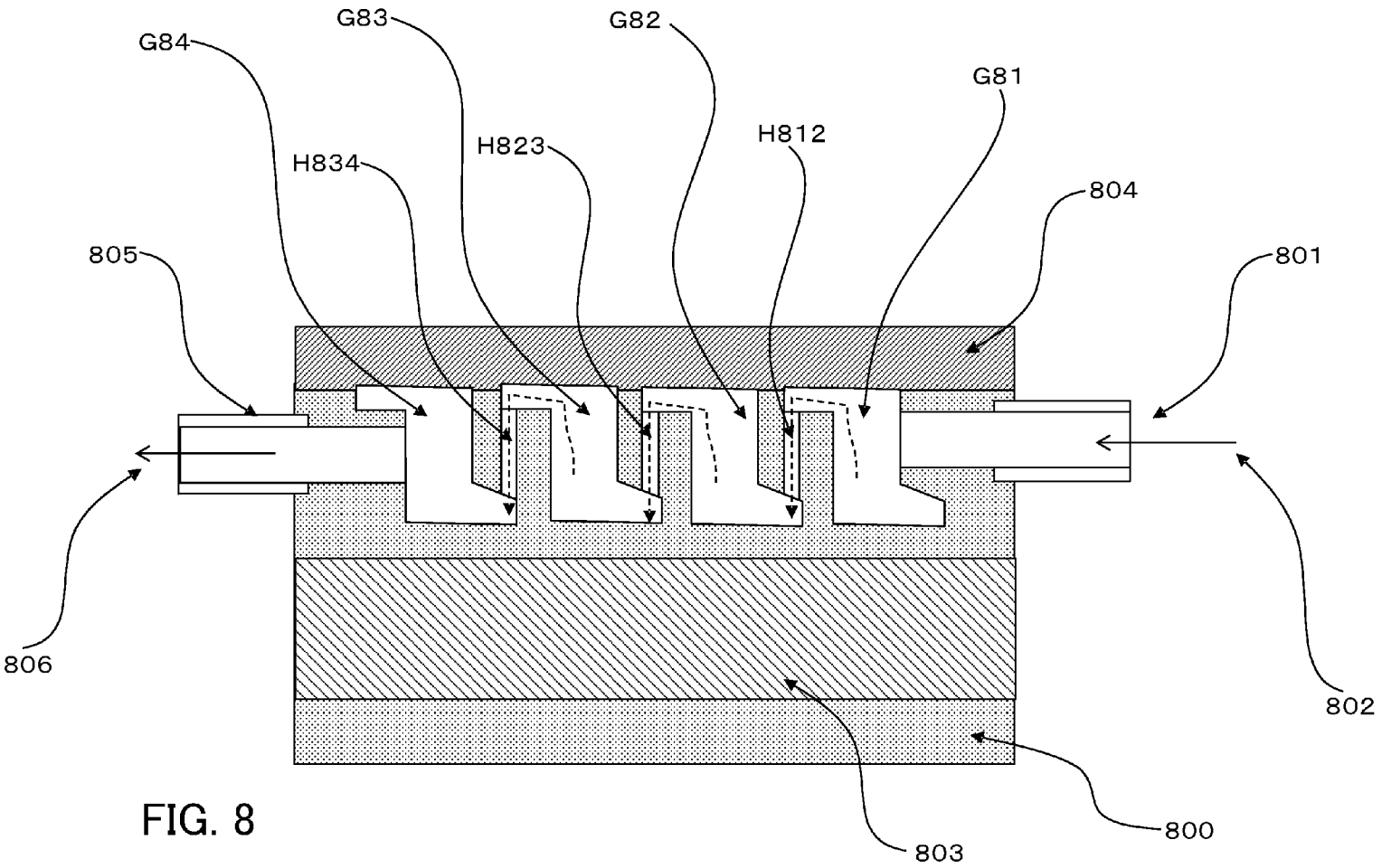
FIG. 8 is a schematic sectional view of a structure where a flow passage is formed on one face of a plate.

FIG. 8 shows an example having a structure where a flow passage is formed on one face of a plate 800 serving as a base.

Figure 1:
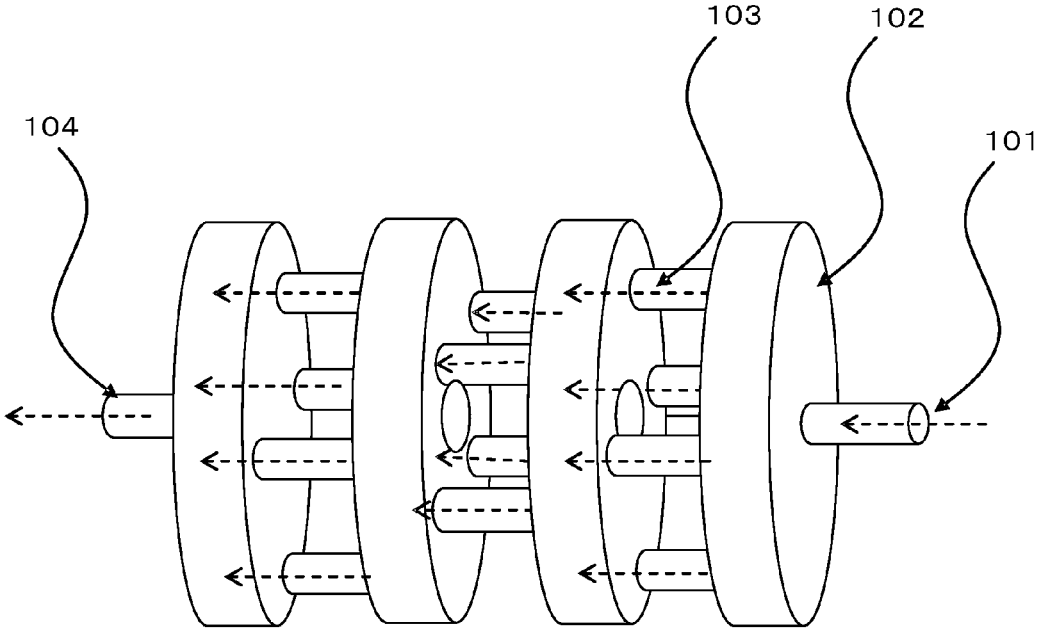
FIG. 1 is a schematic view of one example (Domestic Re-Publication of PCT Patent Application WO2006/030526) of a conventional gas heating apparatus.
Figure 2A:
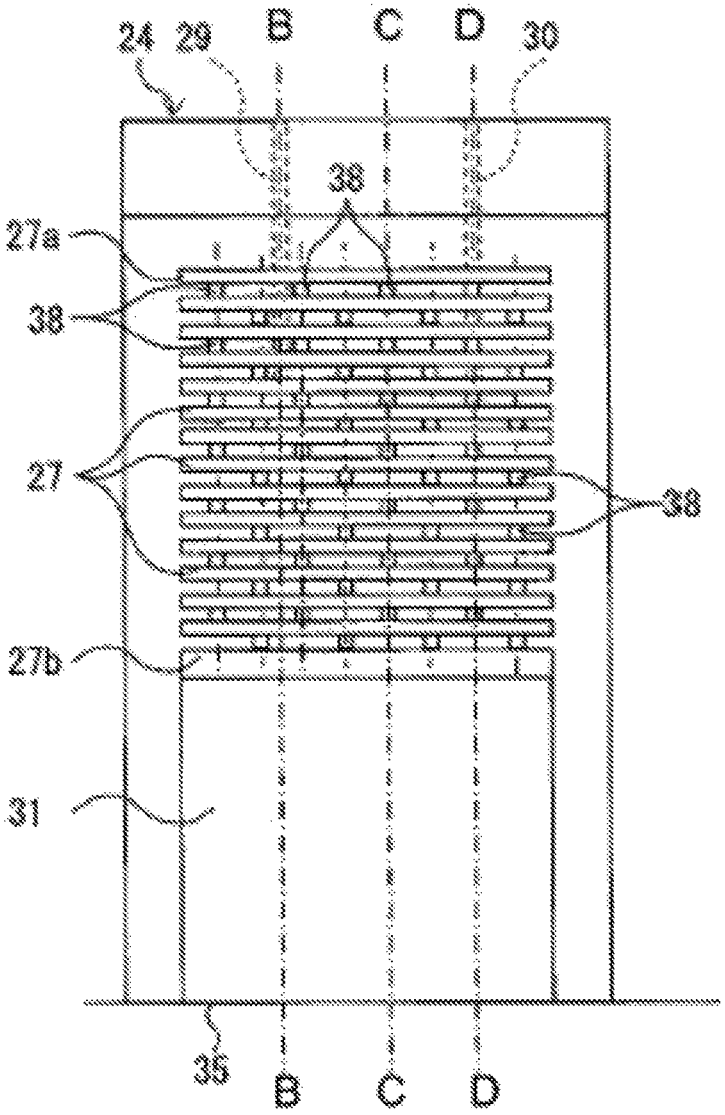
FIGS. 2A to 2D are schematic views of one example (Japanese Patent Application Laid-Open No. 2010-001541, a gas heating apparatus shown in FIG. 5) of a conventional gas heating apparatus.
Figure 2B:
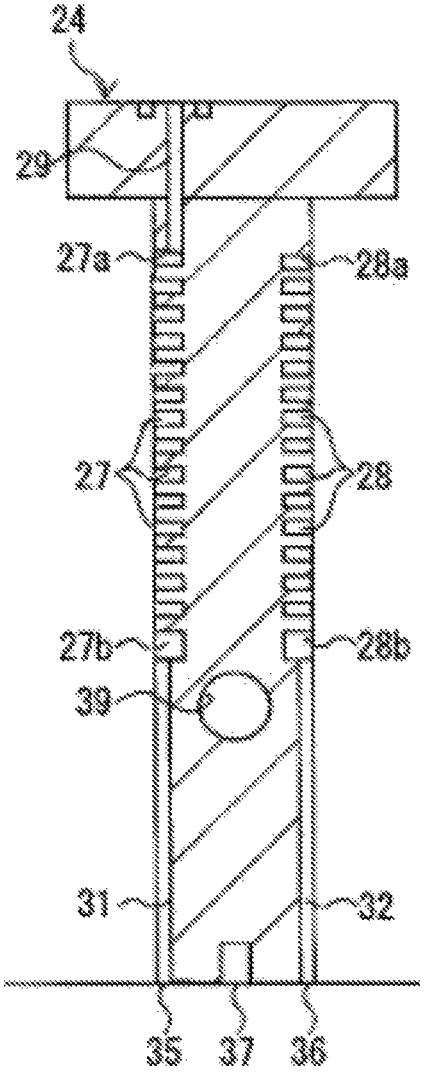
Figure 2C:
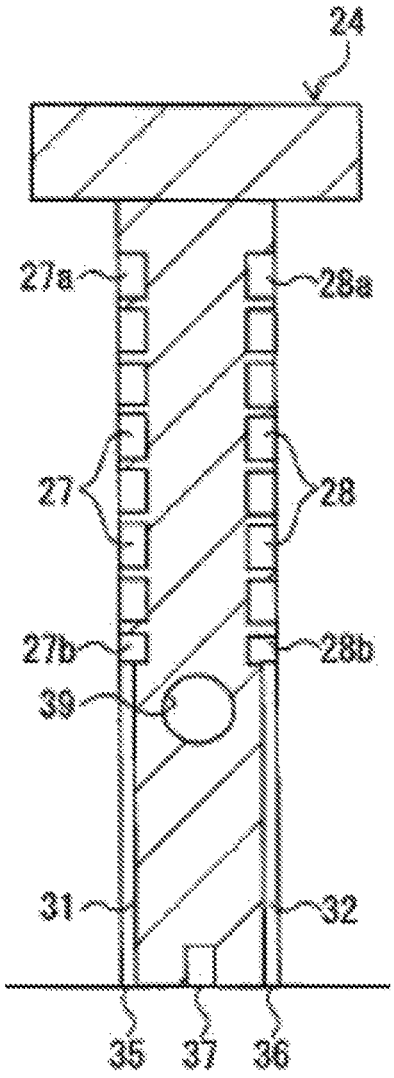
Figure 2D:
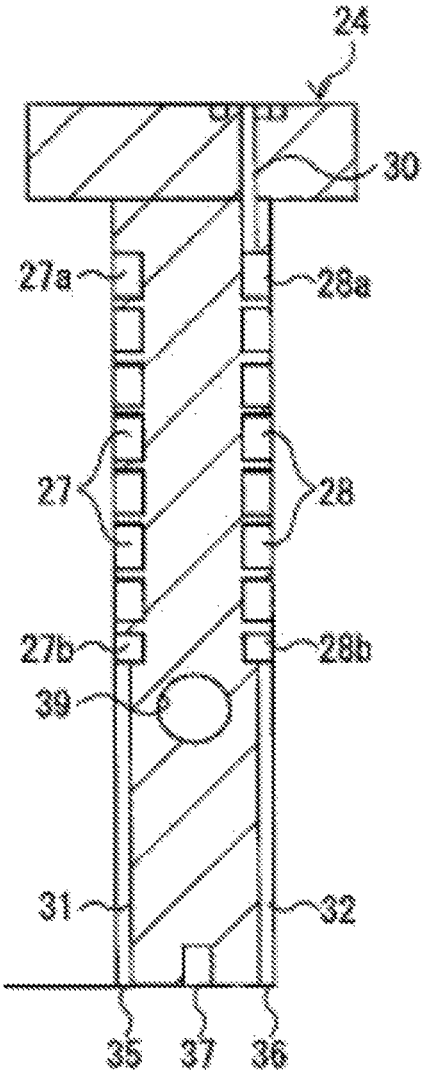
Figure 3:
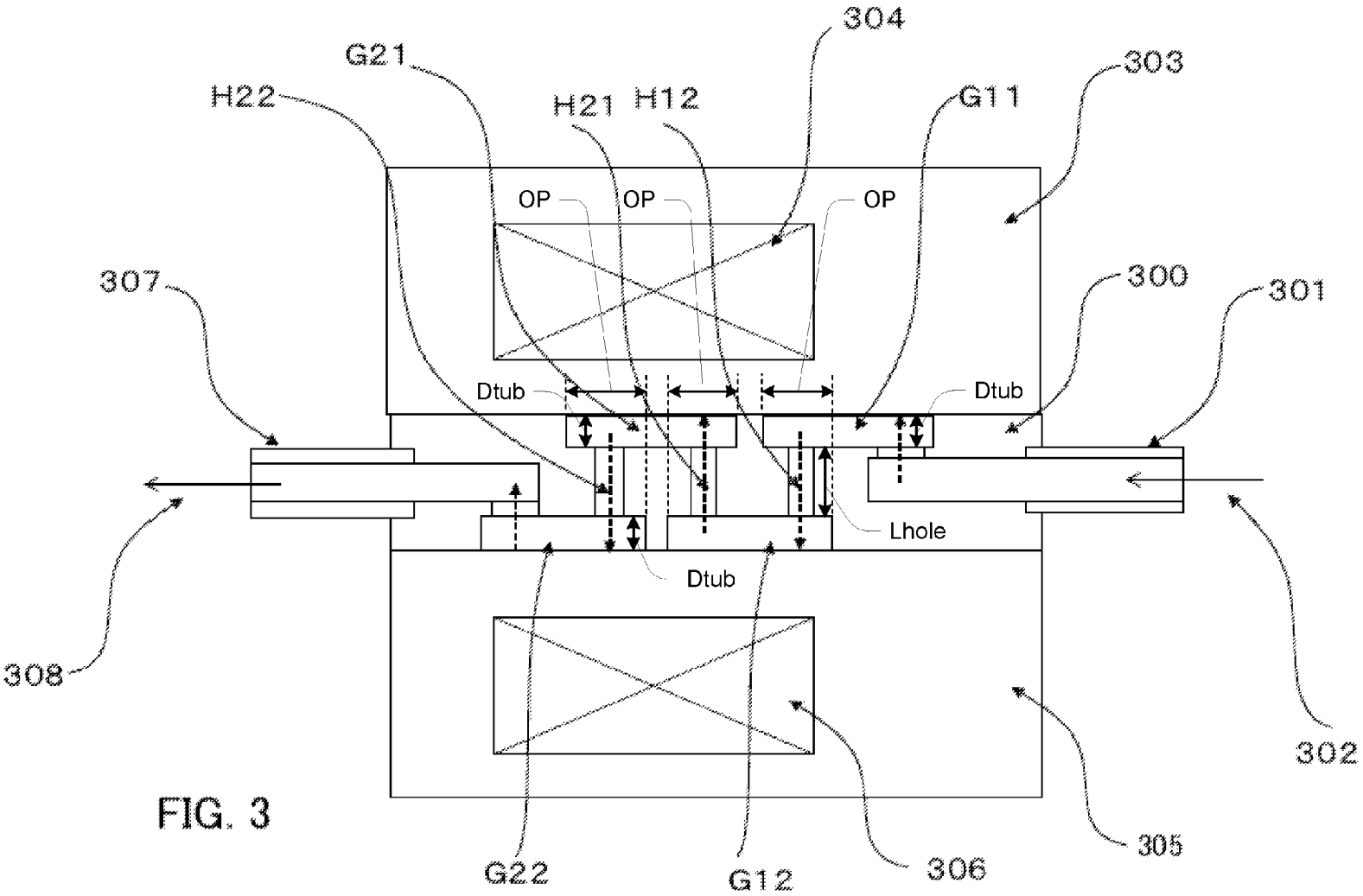
FIG. 3 is a schematic view of a basic mechanism for performing heat exchange between a plate and sealing plates.

When the tub G11 shown in FIG. 3 is caused to correspond to a tub G81 shown in FIG. 8, a tub G82 corresponds to the tub G12 shown in FIG. 3. Similarly, tubs G83 and G84 correspond to the tubs G21 and G22 shown in FIG. 3, respectively. Coupling holes H812, H823, and H834 correspond to the coupling holes H12, H21, and H22 shown in FIG. 3, respectively. A flow passage of fluid is shown by a broken line. This flow passage does not cross the plate 800.

A fluid whose flow speed is increased at the coupling hole impinges on a wall of the plate 800 approximately vertically to perform heat exchange with the wall instantaneously.

In this example, since the plate 800 is heated by a heat source 803 using a heater serving as a heating mechanism, a fluid is heated. When a cooling source 803 using coolant instead of the heating mechanism is provided in the plate, a fluid is cooled.

Since the tubs arranged on one face of the plate become small, the positions of the nearest coupling holes also become close to each other. As the property of a fluid, when coupling holes adjacent to each other form a specific flow passage, flow rate distribution does not occur in an equal distribution fashion. In order to avoid such a phenomenon, it is desirable to arrange respective coupling holes such that axes of the coupling holes do not overlap with one another.

Figure 9:
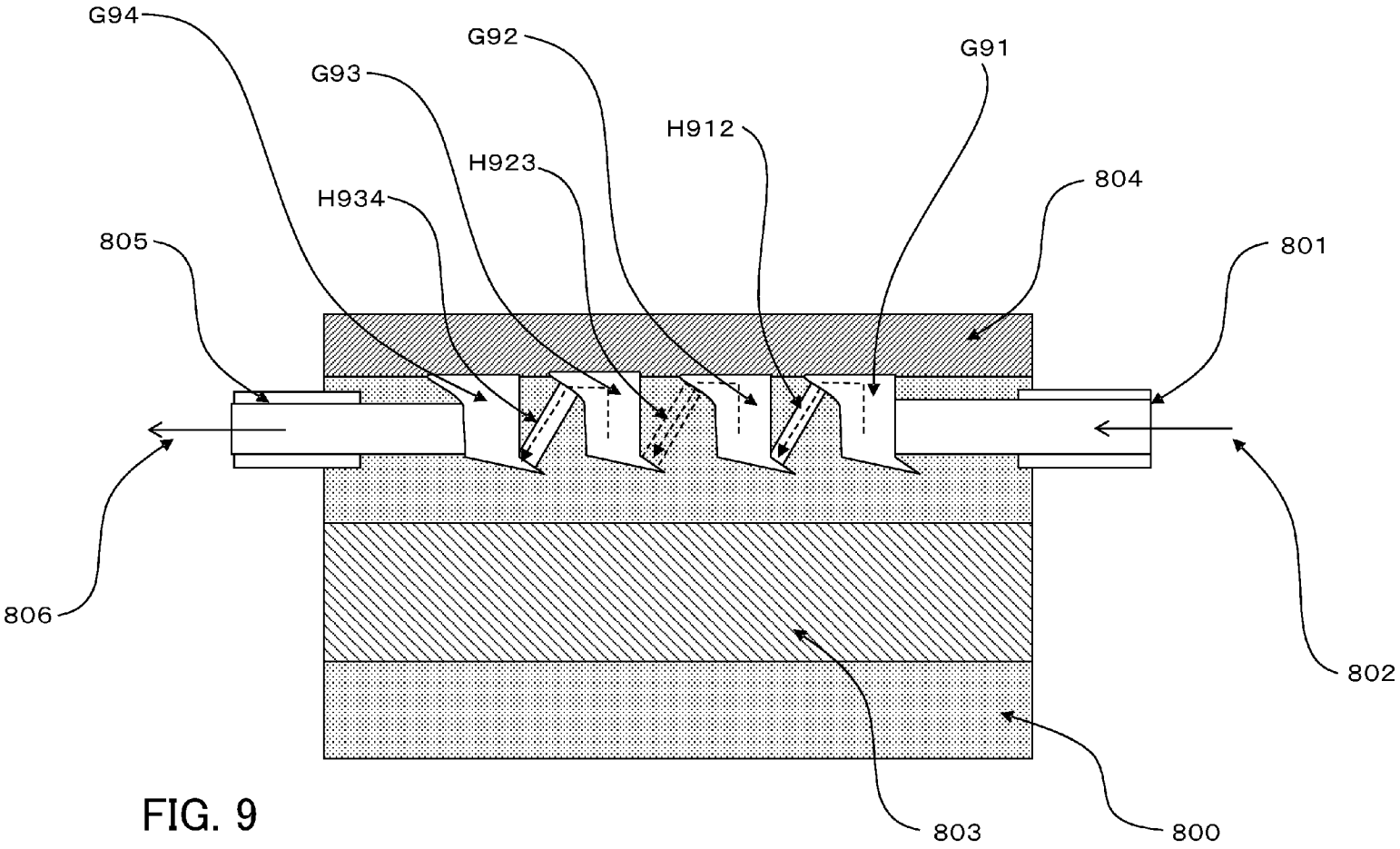
FIG. 9 is a schematic sectional view of another structure where a flow passage is formed on one face of a plate.

FIG. 9 shows a structure where coupling holes are inclined and sizes of tubs are made further small. There is such a merit that a pitch of tubs and a pitch of holes along a flowing direction of a fluid can be made smaller than the case shown in FIG. 8. At this time, the nearest coupling holes put in a relationship between an upstream side and a downstream side are arranged such that respective axes thereof do not overlap with each other in order to keep away the coupling holes positioned at an upstream side and a downstream side from each other. A coupling hole H923 is shown by a broken line in FIG. 9 in order to show such a fact.

Figure 10:
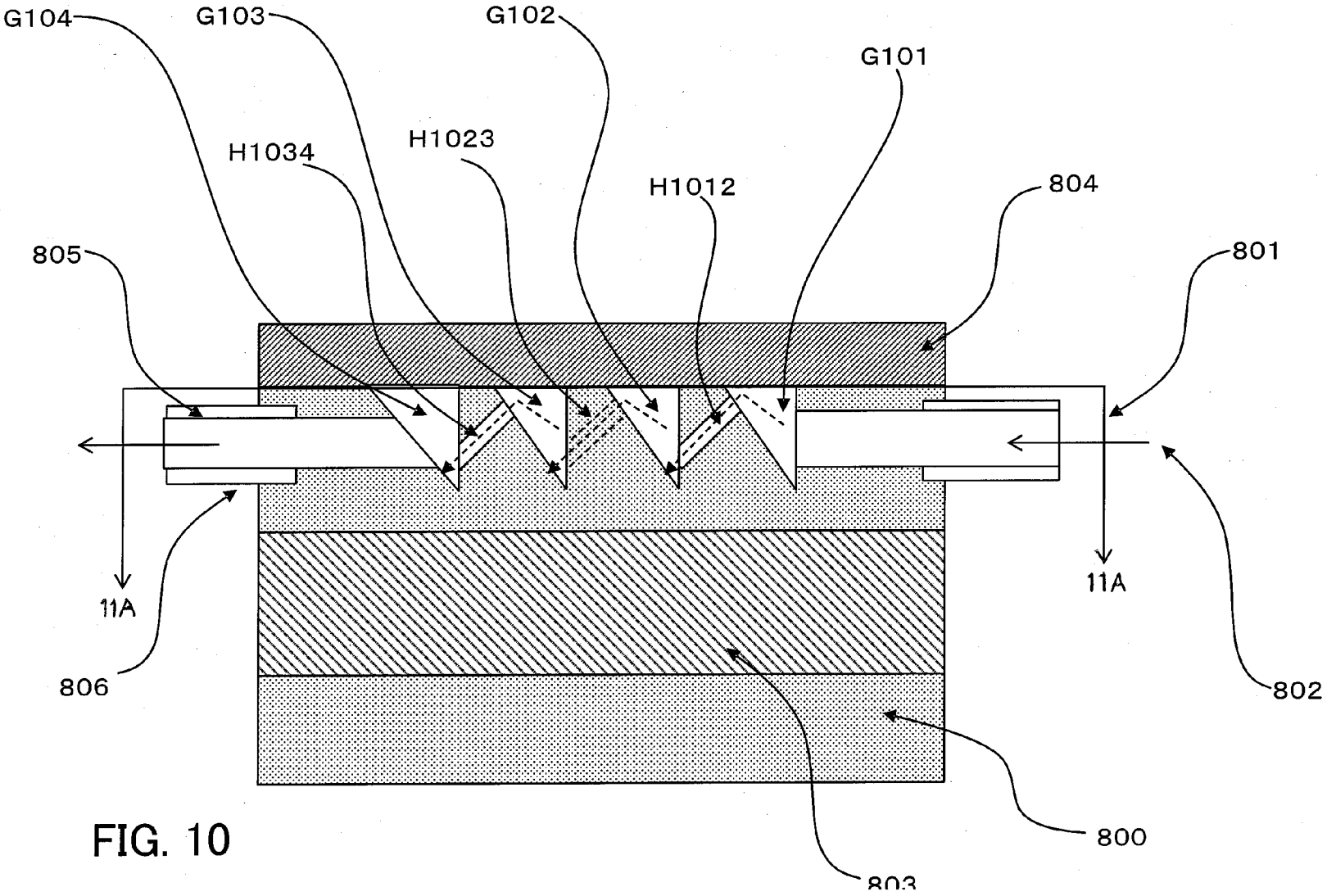
FIG. 10 is a schematic sectional view of still another structure where a flow passage is formed on one face of a plate.

FIG. 10 shows an example where cutting work for forming tubs is made simpler than the case shown in FIG. 9. Since sections of tubs G101, G102, G103, and G104 are approximately triangular, the cutting work is further simple. In this case, also, the nearest coupling holes H1012, H1023, and H1034 put in a relationship between an upstream side and a downstream side are arranged such that respective axes thereof do not overlap with one another. A coupling hole H1023 is shown by a broken line in order to show such a fact.

Figure 11A:
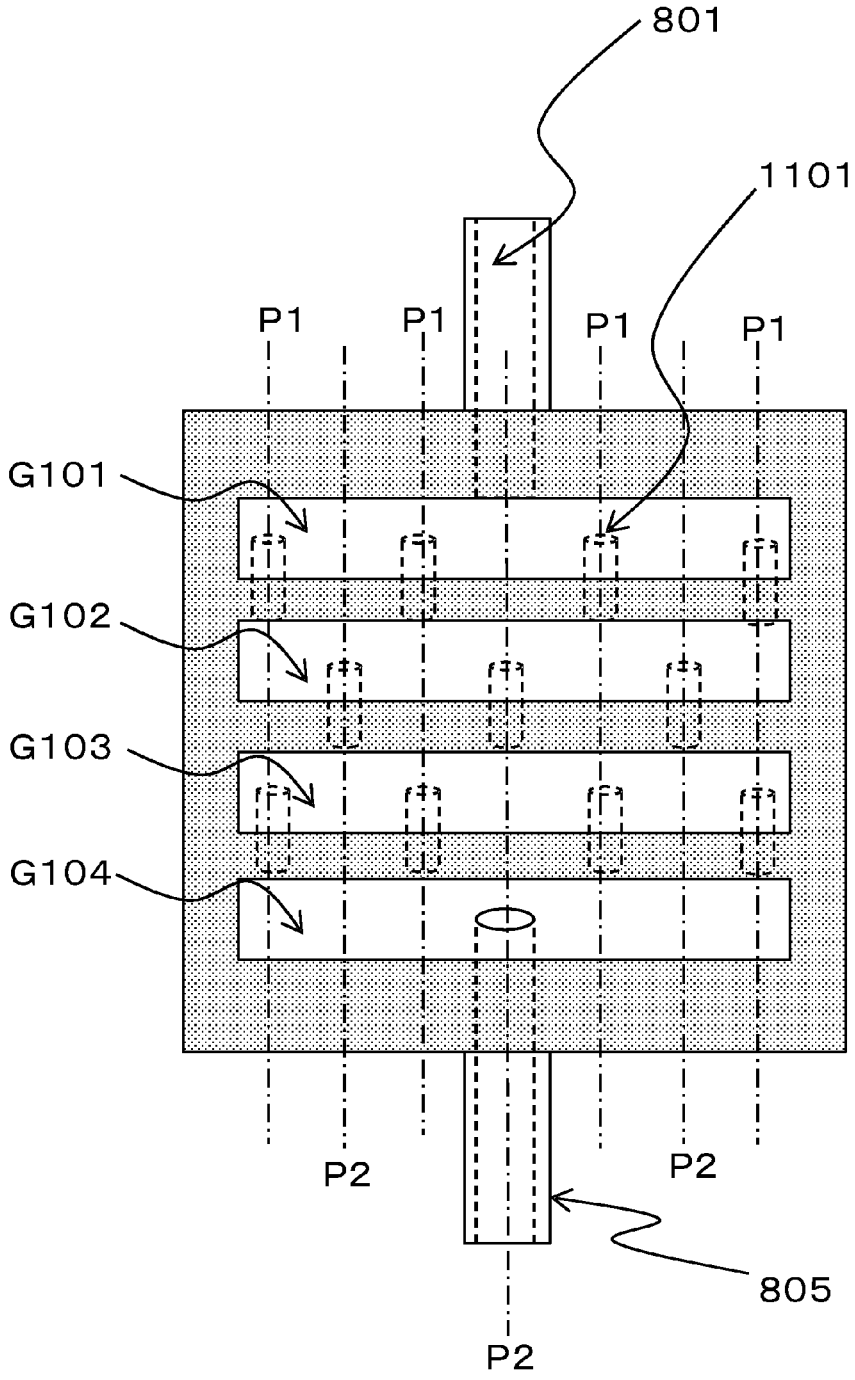
FIG. 11A is a schematic view of an arrangement where nearest coupling holes put in a relationship between an upstream side and a downstream side are not arranged such that axes thereof are the same axis of coupling holes.

FIG. 11A is a sectional view taken along line 11A-11A in FIG. 10. FIG. 11A shows an example having an arrangement where the nearest coupling holes put in a relationship between an upstream side and a downstream side are arranged such that respective axes thereof do not overlap with each other. Straight lines P1 and P2 showing positions of tubs, and axes 1101 of coupling holes are parallel with each other.

Figure 11B:
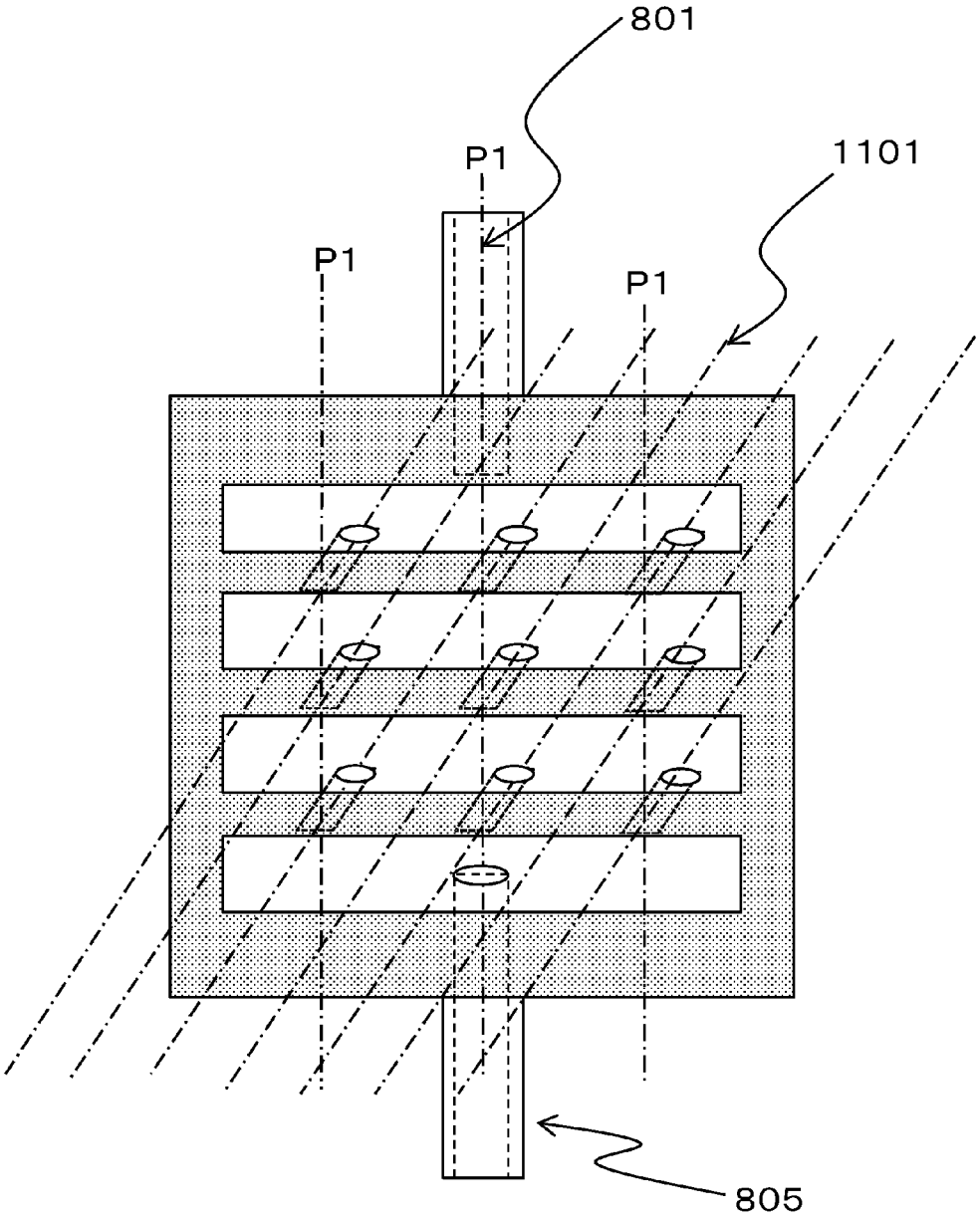
FIG. 11B is a schematic view of an arrangement where straight lines representing the position of tubs and axes of coupling holes are not parallel with each other.

FIG. 11B shows an example having an arrangement where straight lines P1 showing positions of tubs and axes 1101 of coupling holes are not parallel with each other. This case also shows an example having an arrangement where the nearest coupling holes put in a relationship between an upstream side and a downstream side are arranged such that respective axes thereof do not overlap with each other.

Figure 12A:
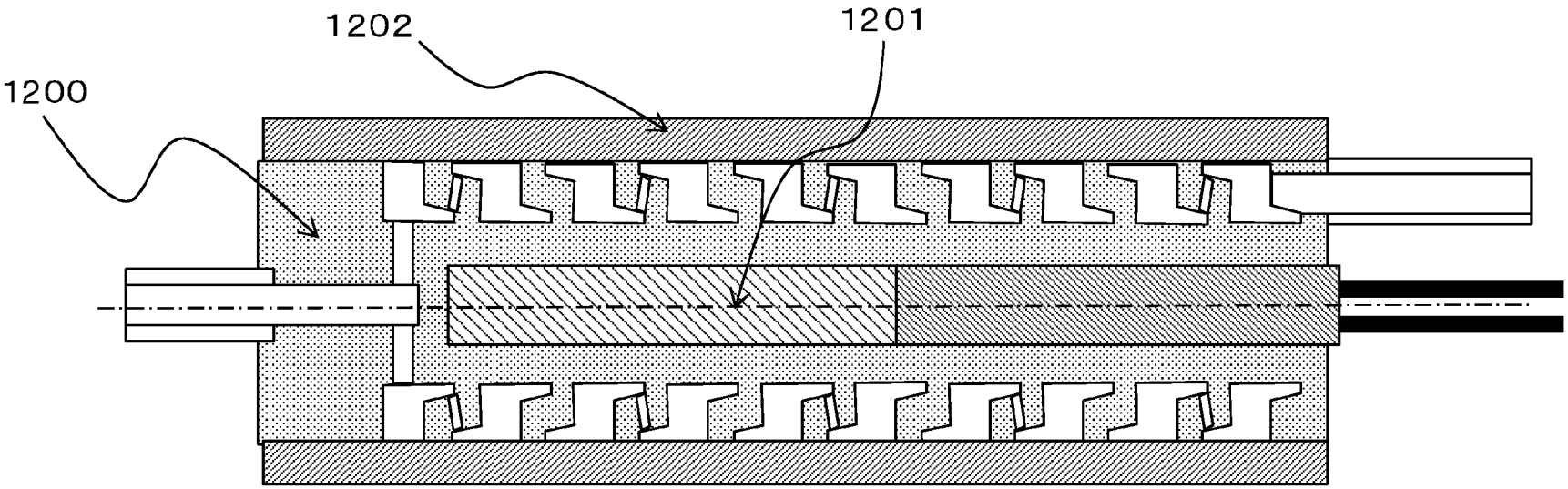
FIG. 12A is a schematic sectional view of a cylinder in a circumferential phase P11, whose surface is formed with a flow passage.
Figure 12B:
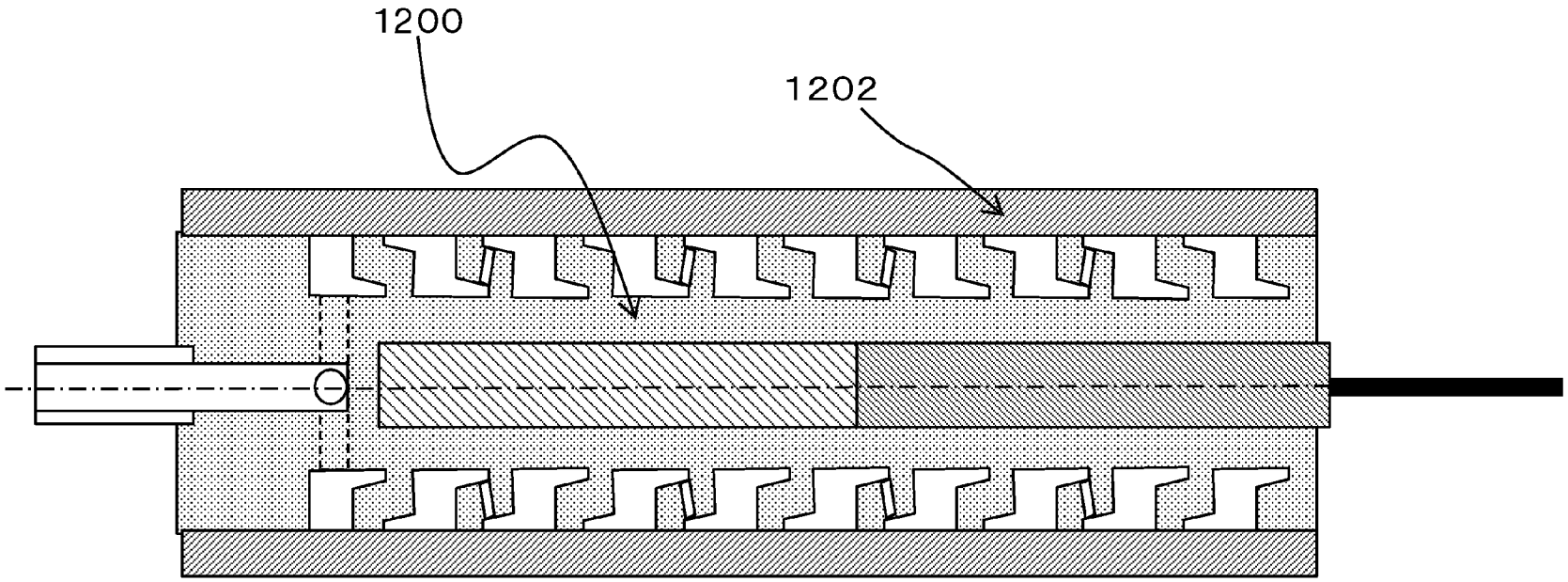
FIG. 12B is a schematic sectional view of a cylinder in a circumferential phase P22, whose surface is formed with a flow passage.

FIGS. 12A and 12B show examples where flow passages are provided on a surface of a cylinder 1200 serving as a base instead of the flow passages being provided on one face of the plate serving as a base. When a fluid is heated, a heater 1201 is positioned inside of the cylinder 1200. In this example, the heater 1201 is arranged at the center of the cylinder 1200.

Tubs are arranged on the surface of cylinder and tubs of the tubs adjacent to each other are coupled by a coupling hole. The structure of the tub can be arbitrarily selected from the structures shown in FIG. 8, FIG. 9, and FIG. 10. The nearest coupling holes put in a relationship between an upstream side and a downstream side are arranged at different positions along a circumferential direction such that respective axes thereof do not overlap with one another.

Figure 12C:
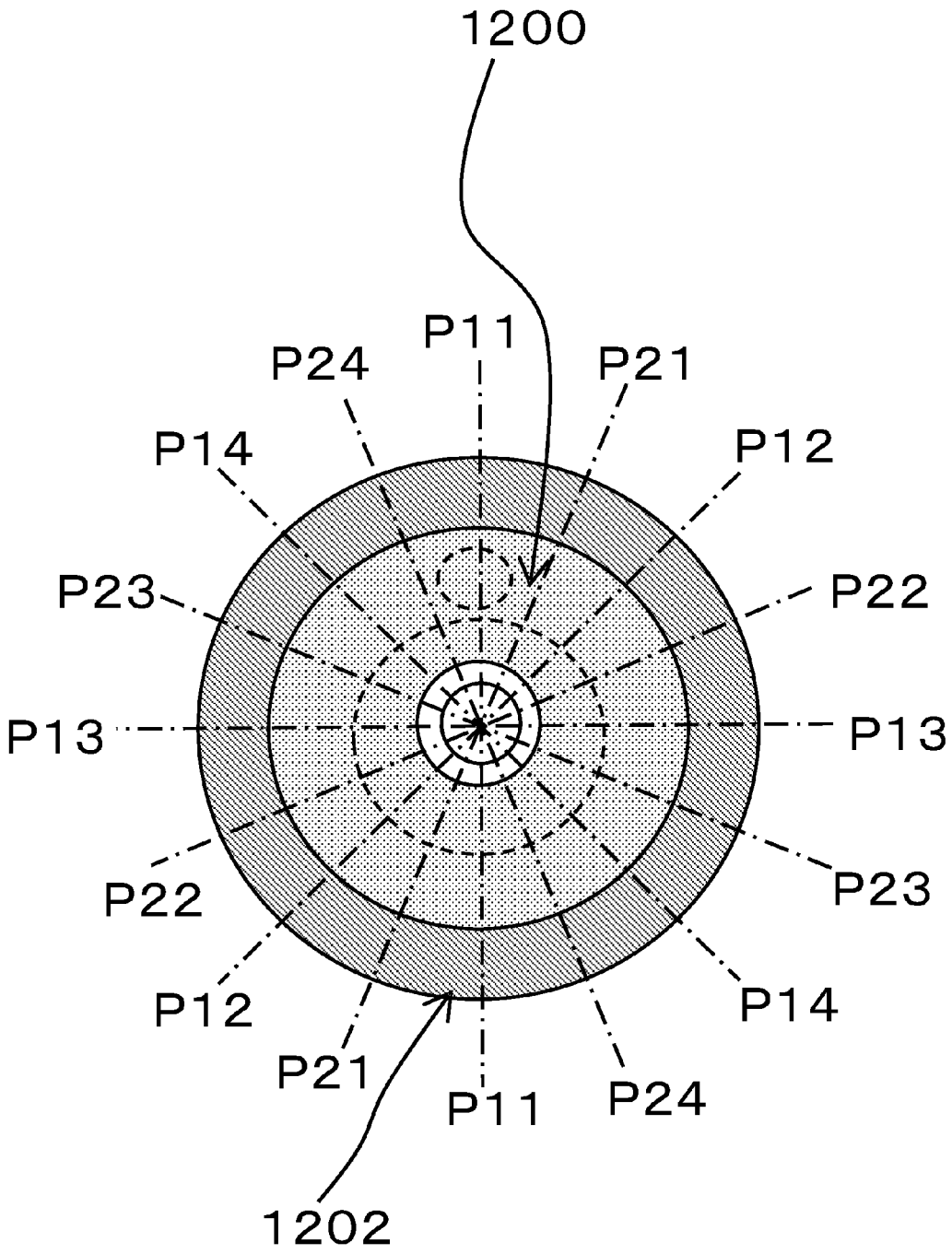
FIG. 12C is a view showing a phase of a position in a circumferential direction where a coupling hole is present.

FIG. 12C shows a phase of a coupling hole at a position in a circumferential direction. This phase is called "circumferential phase" in this specification. Regarding the nearest coupling holes put in a relationship between an upstream side and a downstream side, for example, coupling holes on the upstream side are arranged along circumferential phases P11, P12, P13, and P14, and coupling holes adjacent thereto on the downstream side are arranged along circumferential phases P21, P22, P23, and P24.

FIG. 12A and FIG. 12B show sectional views of a cylinder in circumferential phases P11 and P12, having flow passages formed on a surface thereof. A sealing cylinder 1202 is welded to the cylinder 1200 having flow passages formed on a surface thereof, so that closed flow passages are formed. A fluid accelerated at a coupling hole impinges on a wall of the cylinder at a high speed so that heat exchange is performed efficiently.

Figure 13:
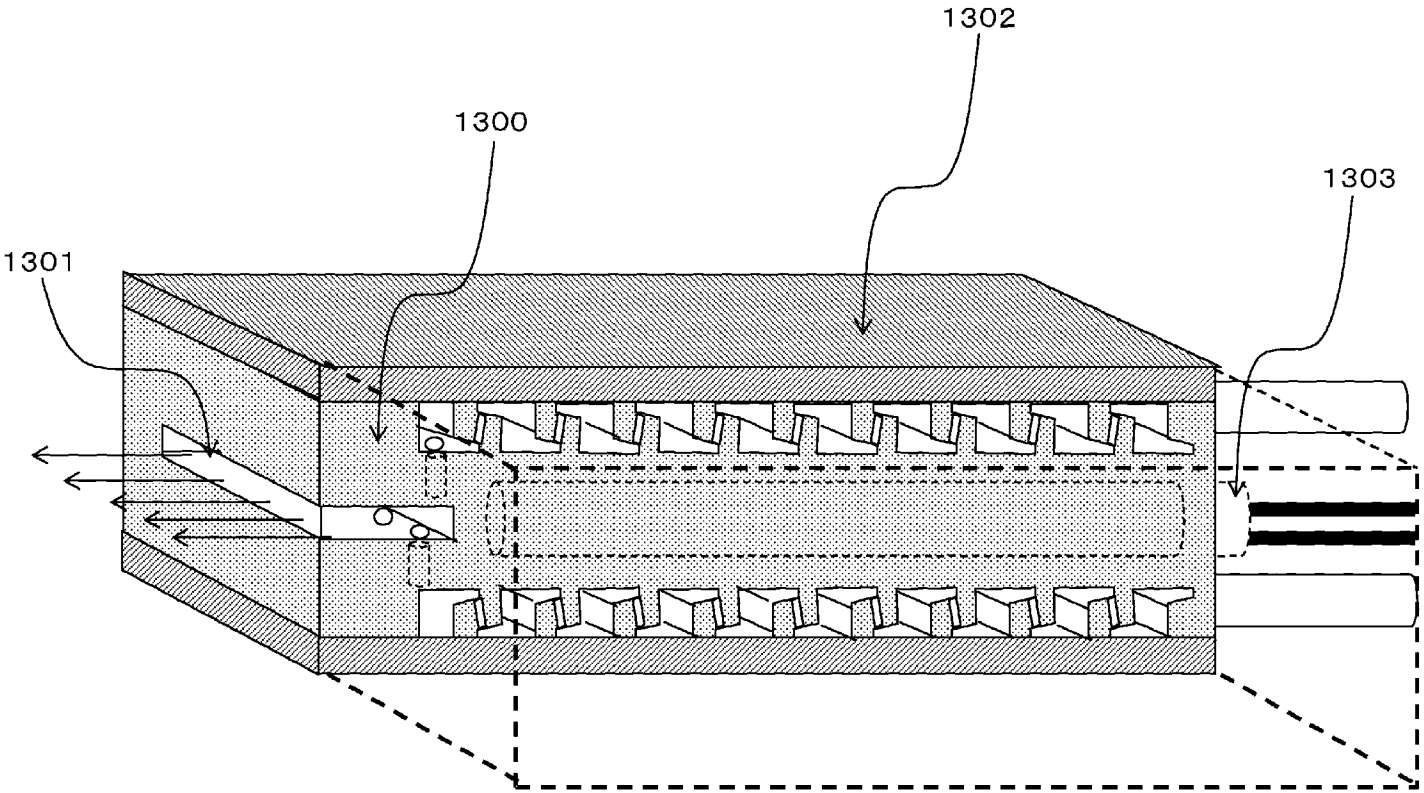
FIG. 13 is a schematic perspective view of a heat exchanging apparatus where flow passages are formed on both faces of a plate and they are collectively taken out of a slit-shaped fluid outlet port.

FIG. 13 is an example of a plate-shaped heat exchanging mechanism. Flow passages are formed on both faces of a plate 1300 serving as a base, and sealing plates 1302 are welded to the plate 1300, so that closed passages are formed on both the faces of the plate 1300. Material is SUS316L. Heated fluids produced on both the faces are collected to be taken out of a slit-shaped fluid outlet port 1301. The heated fluid is suitable for heating a plate-shaped sample.

The method for easily forming the structure of the heat exchanging apparatus for heating or cooling a fluid instantaneously has been shown above. The heat exchanging apparatus can be manufactured by working various metals including stainless steel, aluminum, nickel, iron, chromium, and tungsten.

Further, a multilayer metal or a material coated with metal can be used.

Ceramics, or carbon coated with SiC can be used. Further, a plastic composite material containing carbon such as carbon nanotube or graphene can be used.

Though the examples where only one present apparatus is used are shown, such a configuration can be adopted that a plurality of the present apparatuses are arranged in series or in parallel and temperatures of the respective apparatuses can be set arbitrarily. For example, two fluid heat exchanging apparatuses are connected in series, where it is possible to change a fluid to a gas at a set temperature by a first fluid heat exchanging apparatus and change the gas to a gas having an arbitrarily set temperature by a second fluid heat exchanging apparatus. Further, it is also possible to produce a high-temperature steam from water instantaneously by utilizing the present apparatus which has been size-reduced.

The present invention provides a small-sized part for producing a large amount of gas or liquid which has been heated to a high temperature. Further, the present invention also provides a small-sized heat exchanger to an apparatus for cooling a coolant used for superconductivity. As application fields, the present invention can be used for drying printed matter, a small-sized heater, heating in a greenhouse, production of a high-temperature chemical for cleaning, food heating, sterilization, generation of overheated steam for organic matter decomposition used for biomass power generation, and a cooler of a cooling apparatus in superconductivity installation. The present invention is suitable for a technique for film-forming solar cells or a flat panel display apparatus (FPD) on a large-sized substrate such as a glass substrate at a low cost.

When a temperature of 300° C. or less is handled, a composite material containing carbon can be used. Since a plastics composite material can be worked at a low cost and it has chemical resistance, the present invention provides a high efficient heat exchanger when toxic heat source such as geothermal power generation is used. When the part is used for cooling opposite to heating, the part serves as a heat exchanging part for producing a cooled gas or liquid.

EXPLANATION OF REFERENCE NUMERALS

101 GAS INLET
102 HOLLOW DISC
103 PIPE
104 GAS OUTLET
300 PLATE
301 FLUID INLET PORT
302 INTRODUCTION FLUID
303, 305 SEALING PLATE
304, 306 HEATER
307 FLUID OUTLET PORT
308 DISCHARGE FLUID
G11, G12, G21, G22 TUB
H12, H21, H22 COUPLING HOLE
400 FLUID HEAT EXCHANGING MECHANISM
401 FLUID INTRODUCTION PORT
402 FLUID OUTLET PORT
403, 404 SEALING PLATE
405, 406, 407, 408 HEATER
410 PLATE
G11, G12, G21, G22, G31, G32, G41, G42, G51, G52, G61 TUB
H12, H21, H22, H31, H32, H41, H42, H51, H52, H61 COUPLING HOLE
F1 INTRODUCTION FLUID
F2 DISCHARGE FLUID
500, 700 FLUID HEAT EXCHANGING APPARATUS
501 HEAT-ISOLATING CASE
502 OUTER CASE
503 HEATER
504 HEAT-ISOLATING MATERIAL
505 POWER-FEEDING WIRES
506 FLANGE
601 FLUID INTRODUCTION PORT
602 FLUID INTRODUCTION PORT
603 FLUID OUTLET PORT
610 PLATE
H611, H612, H621 COUPLING HOLE
F11, F12 INTRODUCTION FLUID
L LENGTH OF FLUID OUTLET PORT
W WIDTH OF FLUID OUTLET PORT
701 HEATER CENTER SEALING PLATE
702 HEATER
703, 705 PLATE
704, 706 SEALING PLATE
710 FLUID HEAT EXCHANGING MECHANISM
H711, H712, H721, H722 COUPLING HOLE
800 PLATE
801 FLUID INTRODUCTION PORT
802, 806 FLUID
803 HEAT SOURCE OR COOLING SOURCE
804 SEALING PLATE
805 FLUID OUTLET PORT
G81, G82, G83, G84, G91, G92, G93, G94, G101, G102, G103, G104 TUB
H812, H823, H834, H912, H923, H934, H1012, H1023, H1034 COUPLING HOLE
1101 AXIS OF COUPLING HOLE
P1, P2 STRAIGHT LINE INDICATING POSITION OF TUB
1200 CYLINDER
1201 HEATER
1202 SEALED CYLINDER
P11, P12, P13, P14, P21, P22, P23, P24 CIRCUMFERENTIAL PHASE
1300 PLATE FORMED WITH FLOW PASSAGE ON BOTH SURFACES THEREOF
1301 SLIT-SHAPED FLUID OUTLET PORT
1302 SEALING PLATE
1303 HEATER

What is claimed is:

1. A fluid heat exchanging apparatus comprising a plate (300) including tubs (G11, G21, G12, G22), coupling holes (H12, H21, H22), an introduction port (301), and a blowout port (307), the plate (300) having a first face, a second face opposite to the first face, a first end, and a second end opposite to the first end, a first sealing plate (303) provided in contact with the first face of the plate (300), and a second sealing plate (305) provided in contact with the second face of the plate (300), wherein the tubs (G11, G21, G12, G22) are provided so as to be arranged on each of the first face and the second face of the plate (300) in one direction in a plurality of stages, each of the tubs (G11, G21, G12, G22) has a bottom face and has a depth (Dtub) defined by a distance between the first face or the second face and the bottom face; the tubs (G11, G21) provided on the first face of the plate (300) and the tubs (G12, G22) provided on the second face of the plate (300) are sealed by the first sealing plate (303) and the second sealing plate (305) in an air-tight manner; one tub (G21) provided on the first face of the plate (300) has an overlapping portion (OP) with two tubs (G12, G22) provided adjacent to each other on the second face of the plate (300) in a plane view; each of the coupling holes (H12, H21, H22) couples the bottom face of the tub (G21) provided on the first face of the plate (300) and the bottom face of the tub (G12) provided on the second face of the plate (300) in the overlapping portion (OP), and has a length (Lhole) defined by a distance between the bottom face of the tub (G21) provided on the first face and the bottom face of the tub (G12) provided on the second face, wherein the length (Lhole) of each of the coupling holes (H12, H21, H22) is longer than the depth (Dtub) of each of the tubs (G11, G21, G12, G22); the introduction port (301) is provided on the first end of the plate (300), and is configured to introduce a fluid into one of the tubs (G11) adjacent the first end of the plate (300); the blowout port (307) is provided on the second end of the plate (300), and is configured to discharge the fluid from one of the tubs (G22) adjacent the second end of the plate (300); and heat exchange is performed between the first and second sealing plates (303, 305) and the fluid.

2. The fluid heat exchanging apparatus according to claim 1, wherein the fluid is a gas or a liquid.

3. The fluid heat exchanging apparatus according to claim 2, wherein the gas is a gas obtained by combining at least one of an inert gas containing nitrogen, argon, helium, hydrocarbon, or fluorocarbon;

hydrogen or a reducing gas discharging hydrogen;

a gas containing an element of group VIB and a gas containing an element of group VIIB.

4. The fluid heat exchanging apparatus according to claim 2, wherein the gas is a gas containing water or air.

5. The fluid heat exchanging apparatus according to claim 2, wherein the liquid is water.

6. The fluid heat exchanging apparatus according to claim 1, wherein the first and second sealing plates (303, 305) and the plate (300) are made of metal or metal coated with a different kind of metal.

7. The fluid heat exchanging apparatus according to claim 1, wherein the first and second sealing plates (303, 305) and the plate (300) are made of one of ceramics and a composite material containing carbon.

8. The fluid heat exchanging apparatus according to claim 1, wherein the first and second sealing plates (303, 305) are heated by inserting heaters into the first and second sealing plates (303, 305) or bringing heaters into close contact with the sealing plates, or the plate (300) is heated.

9. The fluid heat exchanging apparatus according to claim 1, wherein the first and second sealing plates (303, 305) or the plate (300) is cooled.

10. The fluid heat exchanging apparatus according to claim 1, wherein the fluid heat exchanging apparatus is expanded at a right angle direction to a flow of the fluid, or the shape of the blowout port (307) is made long in a slit shape.

11. An apparatus for bringing a high-temperature steam produced by the fluid heat exchanging apparatus according to claim 1 and an organic matter into contact with each other.

12. An apparatus in which a plurality of the fluid heat exchanging apparatuses according to claim 1 are arranged in parallel and a plurality of the induction ports (301) and a plurality of the blowout ports (307) are provided.

* * * * *